US011937658B2

(12) United States Patent
Handfield et al.

(10) Patent No.: US 11,937,658 B2
(45) Date of Patent: Mar. 26, 2024

(54) FACE MASK FOR A SPORTS HELMET

(71) Applicant: SPORT MASKA INC., Montreal (CA)

(72) Inventors: Marie-Jeanne Handfield, Montreal (CA); Simon-Pierre Germain, Granby (CA); François-Olivier Dagneau, Dorval (CA); Jean-François Béland, Montreal (CA); Pierre-Luc Beauchamp, Montreal (CA); Ryan Brownridge, Saint-Basile-le-Grand (CA); Pierre Paiement, St-Jerome (CA); Marc-André Element, Kirkland (CA)

(73) Assignee: SPORT MASKA INC., Montreal (CA)

( * ) Notice: Subject to any disclaimer, the term of this patent is extended or adjusted under 35 U.S.C. 154(b) by 184 days.

(21) Appl. No.: 17/394,568

(22) Filed: Aug. 5, 2021

(65) Prior Publication Data

US 2022/0047032 A1 Feb. 17, 2022

Related U.S. Application Data

(60) Provisional application No. 63/064,174, filed on Aug. 11, 2020.

(51) Int. Cl.

| | |
|---|---|
| ***A42B 3/20*** | (2006.01) |
| ***A42B 3/04*** | (2006.01) |
| ***A42B 3/18*** | (2006.01) |

(52) U.S. Cl.

CPC ..... *A42B 3/20* (2013.01); *A42B 3/04* (2013.01); *A42B 3/18* (2013.01); *A42B 3/205* (2013.01)

(58) Field of Classification Search

CPC .. A42B 3/20; A42B 3/205; A42B 3/18; A42B 3/04

See application file for complete search history.

(56) References Cited

U.S. PATENT DOCUMENTS

| | | | | | |
|---|---|---|---|---|---|
| 4,999,856 | A * | 3/1991 | DuVall | A42B 3/20 | 2/9 |
| 5,216,758 | A * | 6/1993 | Rabquer | A42B 3/20 | 2/9 |
| 5,249,347 | A * | 10/1993 | Martinitz | B21K 17/00 | 2/9 |
| 5,575,009 | A * | 11/1996 | Ryvin | A41D 13/1161 | 2/202 |

(Continued)

*Primary Examiner* — Heather Mangine
*Assistant Examiner* — Giao Q T Hoang
(74) *Attorney, Agent, or Firm* — NORTON ROSE FULBRIGHT CANADA

(57) ABSTRACT

A sports helmet has: a shell; a face protector; and a face mask disposed on an inner side of the face protector, the face mask having a body overlapping a nose and a mouth and defining a volume between the face and the body, the body defining a top edge for engaging the face and a bottom edge opposed to the top edge and disposed proximate a chin, the bottom edge secured to a lower portion of the face protector at a location spaced apart from the face to define a gap therebetween, and lateral straps secured to one or both of the face protector and the shell for biasing the top edge against the face of the wearer, the body made of a material offering a flow resistance such that an exhalation flow from the wearer is deviated towards the gap and away from the face protector.

17 Claims, 14 Drawing Sheets

(56) References Cited

U.S. PATENT DOCUMENTS

| | | | | |
|---|---|---|---|---|
| 5,799,337 | A * | 9/1998 | Brown | A42B 3/08 2/424 |
| 2005/0015839 | A1* | 1/2005 | Krzysik, Jr. | A63B 69/3608 2/15 |
| 2008/0066208 | A1* | 3/2008 | Tagliente | A42B 3/20 2/9 |
| 2008/0092277 | A1* | 4/2008 | Kraemer | A42B 3/205 24/458 |
| 2008/0283063 | A1* | 11/2008 | Wilcox | A42B 3/28 128/206.17 |
| 2009/0014005 | A1* | 1/2009 | MacKinnon | A42B 3/20 2/171.3 |
| 2012/0066813 | A1* | 3/2012 | Singh | A42B 3/20 2/173 |
| 2017/0086528 | A1* | 3/2017 | Reese | A42B 3/20 |
| 2018/0264294 | A1* | 9/2018 | Hancock | A41D 13/1138 |

* cited by examiner

FACE MASK FOR A SPORTS HELMET

CROSS-REFERENCE TO RELATED APPLICATION

The present application claims priority on U.S. Patent Application No. 63/064,174 filed Aug. 11, 2020, the entire contents of which are incorporated herein by reference.

TECHNICAL FIELD

This disclosure generally relates to the field of sporting goods and, more particularly, to protective sports helmets with face protectors.

BACKGROUND

Some protective sports helmets include a full-face protector, also referred to as full visor, for protecting the face, including the jaw, of a wearer of the helmet. Such a full-face protector (hereinafter, simply "face protector") includes either a transparent material or a grid. Openings are typically defined through the face protector at various locations, depending on the type of material and/or the intended use/sport of the helmet and full-face protector. Such openings may permit the transmission of certain viruses to or from the wearer of the helmet. There is consequently a need to reduce the risk of such transmission.

SUMMARY

In one aspect, there is provided a sports helmet comprising: a shell enclosing at least a portion of a head of a wearer; a face protector secured to the shell for covering at least a portion of a face of the wearer; and a face mask disposed on an inner side of the face protector, the face mask having a body sized for overlapping a nose and a mouth of the wearer, the body shaped to define a volume between the face of the wearer and the body, the body defining a top edge for engaging the face of the wearer and disposed above the nose of the wearer and a bottom edge opposed to the top edge and disposed proximate a chin of the wearer, the bottom edge secured to a lower portion of the face protector at a location spaced apart from the face of the wearer to define a gap between the bottom edge and the face of the wearer, and lateral straps extending from respective lateral sides of the body and secured to one or both of the face protector and the shell for biasing the top edge against the face of the wearer, wherein the body is made of a material offering a flow resistance such that an exhalation flow from the wearer is deviated towards the gap and away from the face protector.

The sports helmet described above may have one or more of the following features, in whole or in part, and in any combination.

In some embodiments, the face protector defines openings, the face mask covering some of the openings that are facing the mouth of the wearer.

In some embodiments, the gap is defined between the chin and/or cheeks of the wearer.

In some embodiments, the face protector includes a chin cup, a portion of the face mask received between the face protector and the chin cup to define the gap and the volume.

In some embodiments, a bottom strap has a first end and a second end opposed to the first end, the first end secured to an outer side of the body of the face mask, the second end removably securable to an inner side of the body of the face mask.

In some embodiments, the top edge of the body of the facemask defines a contact area shaped to follow the face of the wearer, the top edge sealingly engaging the face of the wearer at the contact area.

In some embodiments, the face protector defines longitudinal members and transverse members, the lateral straps wrapping around the longitudinal members, each of the lateral straps defining a first fastener and a second fastener at respective opposed ends of the lateral straps, the first fastener removably securable to the second fastener.

In some embodiments, a bottom strap is secured to the bottom edge and wrapping around one of the transverse members, a distal end of the bottom strap defining a third fastener removably securable to a fourth fastener located on an inner side of the body of the face mask.

In some embodiments, the face protector defines longitudinal members and transverse members, the lateral straps wrapping around a bottom one of the transverse members.

In some embodiments, two bottom straps are secured to the bottom edge, the two bottom straps wrapping around the bottom one of transverse members, each of the two bottom straps defining a third fastener and a fourth fastener removable securable to the third fastener.

In some embodiments, the body of the face mask defines a cup-shape for receiving a portion of the face of the wearer and for defining the volume.

In some embodiments, the face mask is removably securable to the face protector.

In another aspect, there is provided a sports helmet comprising: a shell enclosing at least a portion of a head of a wearer; a face protector secured to the shell and configured for covering at least a portion of a face of the wearer; and a face mask removably securable to the face protector and having a body sized for covering a nose and a mouth of the wearer, the body shaped to define a volume between the face of the wearer and the body, the body defining a top edge for engaging the face of the wearer above the nose of the wearer and a bottom edge opposed to the top edge and disposed proximate a chin of the wearer, the body made of a material having a stiffness selected such that a shape of the body is maintained when the wearer is breathing, lateral straps extending from respective lateral sides of the body and secured to one or both of the face protector and the shell for biasing the top edge against the face of the wearer, and a gap between the bottom edge and the face of the wearer, the gap communicating with the volume and oriented away from the face protector such that an exhalation flow from the wearer exits the volume in a direction facing away from the face protector.

The sports helmet described above may have one or more of the following features, in whole or in part, and in any combination.

In some embodiments, a bottom strap defines a loop and a chip strap secured to the shell, the chin strap receivable within the loop of the bottom strap.

In some embodiments, each of the lateral straps includes an elastic strap portion secured to the body and a webbing strap portion secured to the elastic strap portion, snap buckles connected to the webbing strap portions and defining first fasteners removably engageable to second fasteners secured to the shell.

In some embodiments, the face protector is a half-visor.

In some embodiments, the gap is defined between the chin and/or cheeks of the wearer.

In some embodiments, the top edge of the body of the facemask defines a contact area shaped to follow a shape of the face of the wearer, the top edge sealingly engaging the face of the wearer at the contact area.

In some embodiments, the body of the face mask defines two internal edges secured to one another, the body of the face mask defining a cup-shaped for receiving a portion of the face of the wearer and for defining the volume.

In yet another aspect, there is provided a face protection assembly for a sports helmet, comprising: a face protector securable to a shell of the sports helmet, the face protector sized for covering at least a portion of a face of a wearer; and a face mask removably secured to the face protector on an inner side of the face protector, the face mask having a body shaped to define a volume between the face of the wearer and the body, the body defining a top edge shaped to engage the face of the wearer and disposed above a nose of the wearer and a bottom edge opposed to the top edge and disposed proximate a chin of the wearer, the bottom edge secured to a lower portion of the face protector at a location spaced apart from the face of the wearer to define a gap between the bottom edge and the face of the wearer and lateral straps extending from respective lateral sides of the body and secured to the face protector and/or the shell for biasing the top edge against the face of the wearer, wherein the body is made of a material offering a flow resistance such that an exhalation flow from the wearer is deviated towards the gap and away from the face protector.

The face protector described above may have one or more of the features identified above and herein, in whole or in part, and in any combination.

Many further features and combinations thereof concerning the present improvements will appear to those skilled in the art following a reading of the instant disclosure.

DETAILED DESCRIPTION

Figure 1:
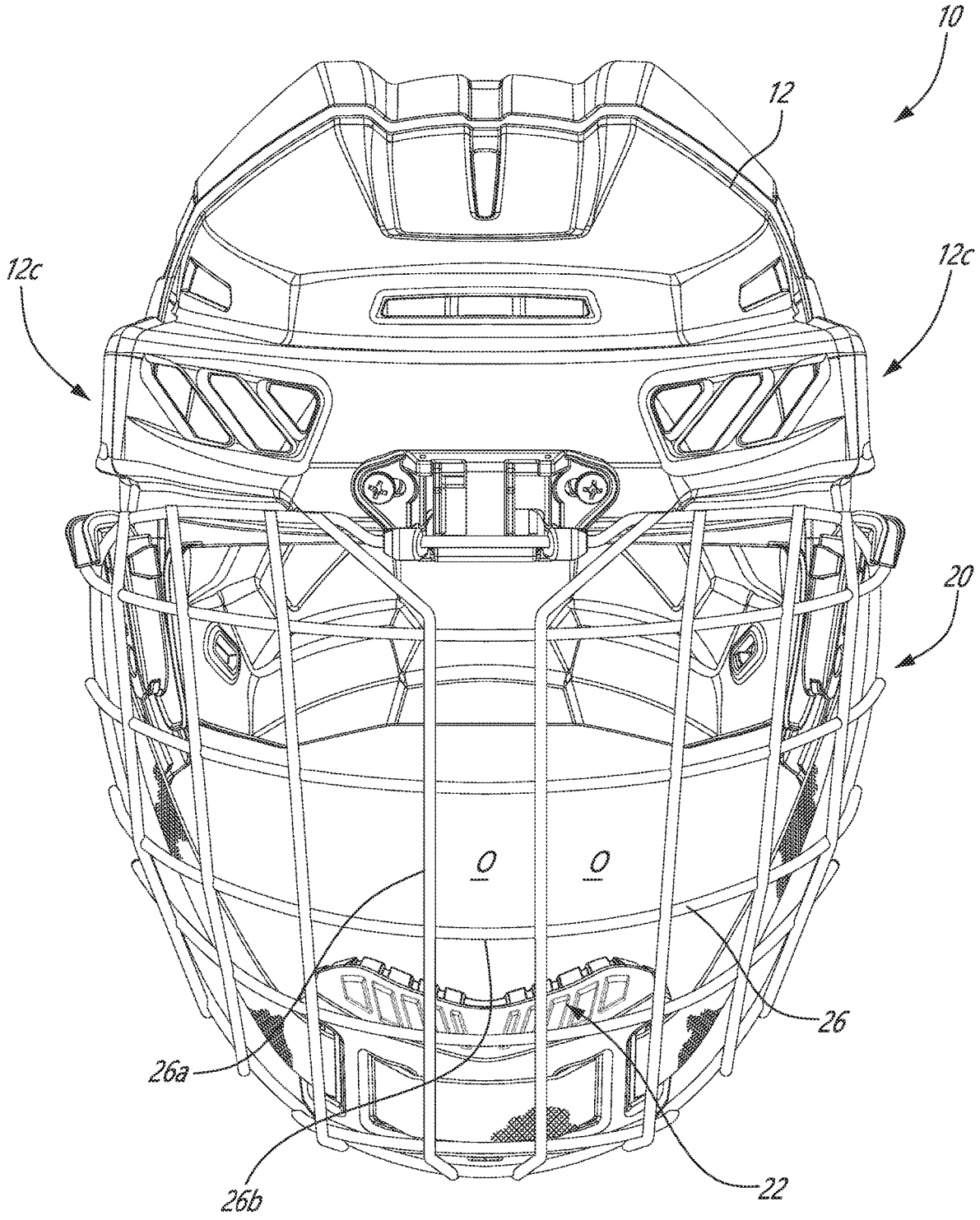
FIG. 1 is a front view of a sports helmet equipped with a face protector in accordance with one embodiment.
Figure 2:
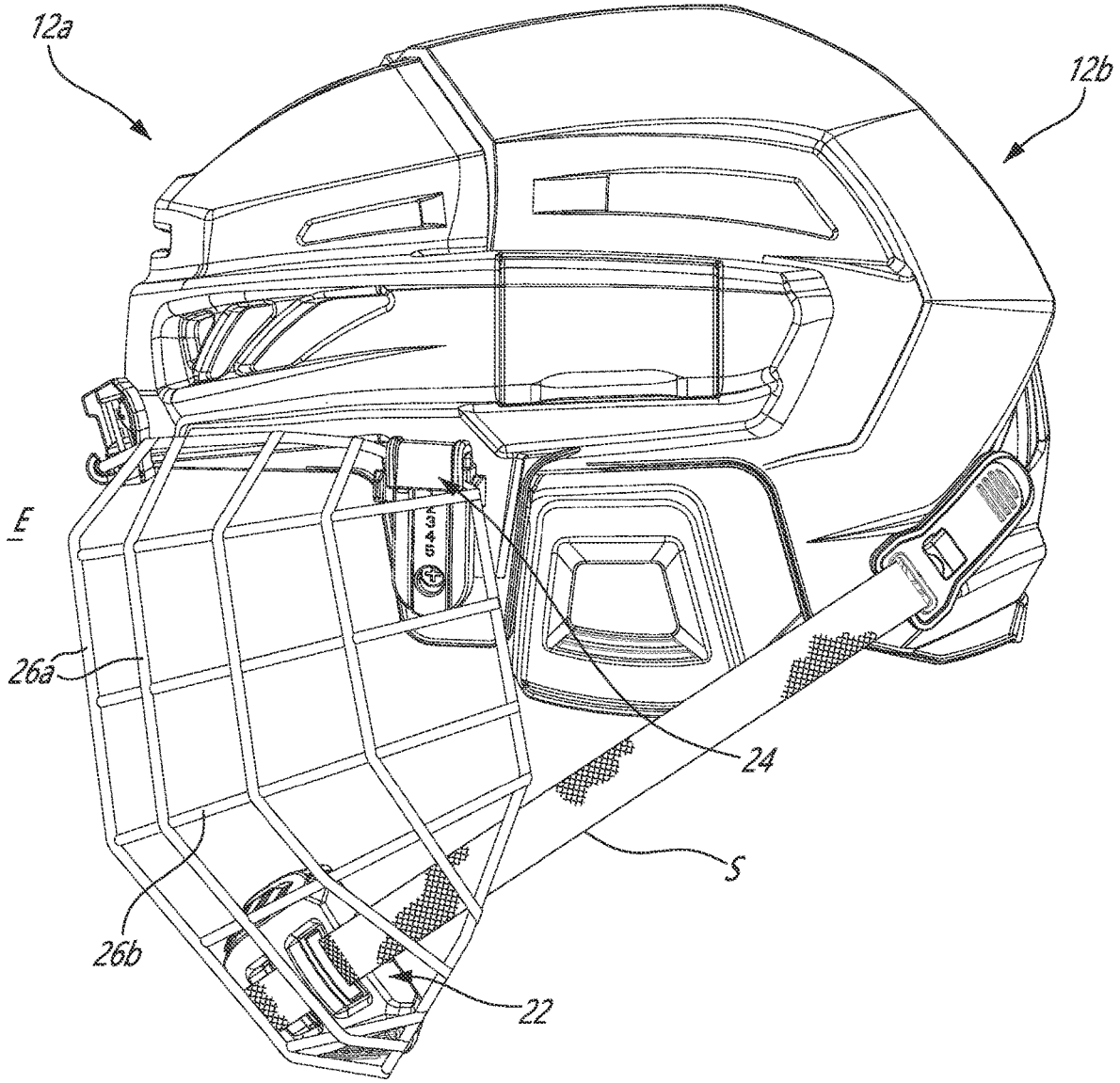
FIG. 2 is a side view of the sports helmet and face protector of FIG. 1.

Referring to FIGS. 1-2, an embodiment of a protective sports helmet (hereinafter simply "helmet") is shown generally at 10. The helmet 10 is depicted as an ice hockey (or simply "hockey") helmet, but the present disclosure may apply to any other kind of protective helmets intended to be used for sporting activities, such as but not limited to a lacrosse helmet, a baseball helmet, and a football helmet. In the embodiment shown, the helmet 10 is equipped with a face protector 20 that is removably securable to the helmet 10 and adapted to protect a face of the user.

In the embodiment shown, the helmet 10 has a helmet body 12 that covers a head of a wearer when the helmet 10 is worn. The helmet body 12 has a front portion 12*a* covering and protecting a corresponding front portion of the head of the wearer, and a rear portion 12*b* configured to cover and protect a corresponding rear portion of the head. The front and rear portions 12*a*, 12*b* of the body 12 are slidably engaged to one another and define two side portions 12*c* of the helmet body 12 configured to cover and protect corresponding side portions of the head.

The face protector 20 extends from and is positioned below the front portion 12*a*, and generally extends towards the side portions 12*c*, for covering the entirety of the face of the wearer. The face protector 20 is thus adapted to protect a majority if not all of the face of the wearer when the helmet is worn.

In the embodiment shown in FIG. 1, the face protector 20 is a wire grid face protector and is substantially adapted to protect the face of the wearer including the mouth, jaw and chin. In the embodiment shown, the face protector 20 includes a chin cup 22 along its lower portion. The chin cup 22 may be fixed to the wire grid of the face protector 20 via bands S or displaceable relative thereto. The chin cup 22 may be attached to the face protector 20 in many ways. For instance, the chin cup 22 may be directly attached to a bottom portion of the face protector 20, it may be attached to side portions of the face protector 20 via straps, or it may be attached to the side of the helmet body 12 via straps. Any suitable means for attaching the chin cup 22 are contemplated without departing from the scope of the present disclosure. The face protector 20 has a portion 24 adapted to be mounted to the helmet body 12. In the embodiment shown, the portion 24 includes a wire of the grid of the face protector 20. Alternatively, the face protector 20 can be a visor or any other protective shield as will be described below.

The face protector 20 includes a wire grid 26 having a plurality of longitudinal wires 26*a* and transversal wires 26*b* secured to the longitudinal wires 26*a*. The longitudinal wires 26*a* extends substantially parallel to a vertical direction extending from a chin of the wearer to a forehead of the wearer. The transversal wires 26*b* extend substantially transversally (e.g., perpendicularly) to the longitudinal wires 26*a*. The grid 26 defines openings O between the longitudinal and transverse wires 26*a*, 26*b*. These openings O are sized to limit objects from traversing the grid 26 to avoid hurting the wearer. These openings O are therefore sized to be smaller than objects that can potentially hurt a wearer, such as, for instance, hockey stick blades, hockey pucks, and so on.

Figure 3:
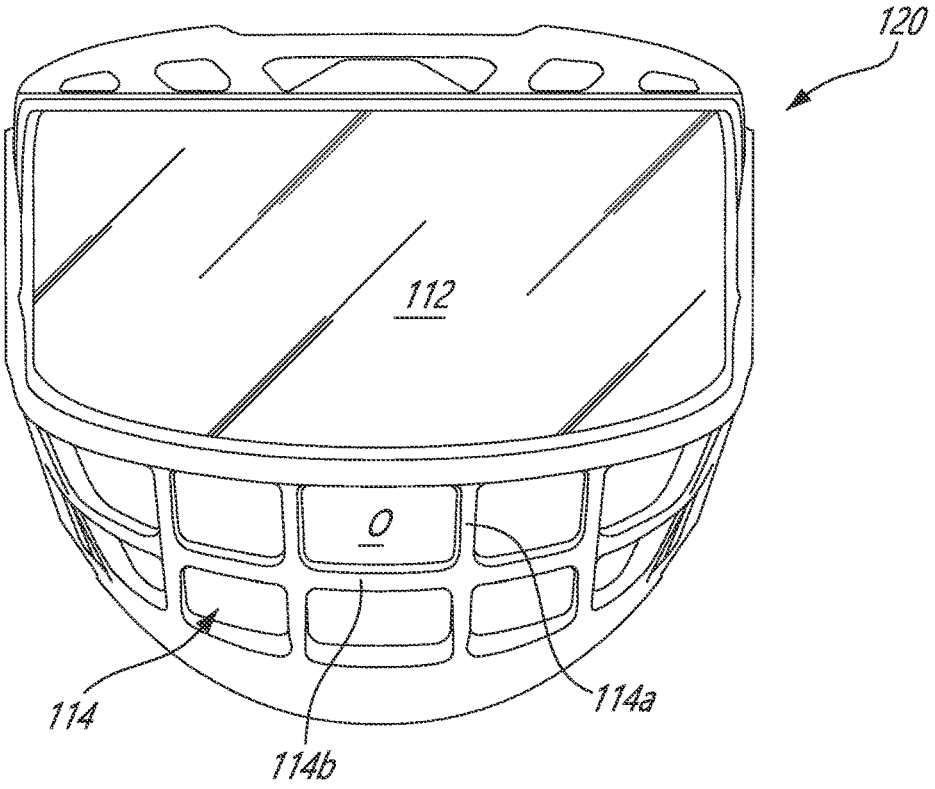
FIG. 3 is a front view of a face protector for the sports helmet of FIG. 1 in accordance with another embodiment.
Figure 4:
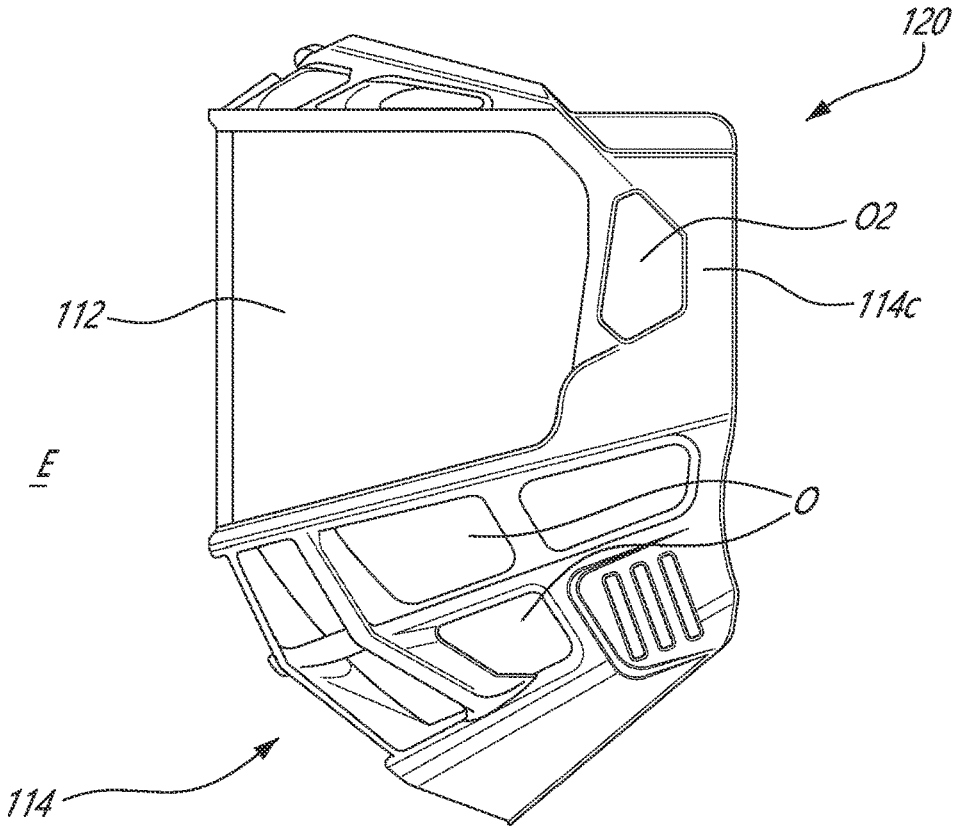
FIG. 4 is a side view of the face protector of FIG. 3.

Referring now to FIGS. 3-4, another embodiment of a face protector is shown generally at 120. It will be appreciated that the face protector 120 described below with reference to FIGS. 3-4 may be used with the helmet 10 of FIG. 1.

The face protector 120 may comprise any suitable material, provided that it is substantially transparent and has suitable impact resistance. For example, in one embodiment, the face protector 120 comprises polymeric material. More particularly, in this embodiment, the polymeric material of the face protector 120 is polycarbonate. The face protector 120 may comprise any other suitable polymeric material and/or any other type of material in other examples of implementation (e.g., clear nylon, urethane-based material, polymethyl methacrylate, etc.).

The face protector 120 has a transparent visor portion 112 for covering at least partially the wearer's forehead, the eyes of the wearer, and portions of the right and left sides the face of the wearer. It is understood that the terms "transparent visor portion" covers a portion that is at least partially transparent, clear, translucent, translucid or light-transmitting to allow the wearer to properly see through the visor portion 112. The face protector 120 also comprises a bottom portion 114 for at least partially covering and encircling a mouth and a chin of the wearer, right and left side portions for covering the right and left sides of the wearer's face and a top portion for at least partially covering the forehead.

In the embodiment shown, the bottom portion 114 of the face protector 120 defines openings O between longitudinal and transverse ribs 114*a*, 114*b*. The longitudinal and transverse ribs 114*a*, 114*b* may be made of the same material as that of the visor portion 112 and thus form a monolithic, one-piece face protector 120 that is entirely formed of one material (e.g. the above-described polymeric material for example). Other materials are however contemplated. For example, in certain embodiments the bottom portion 114 of the face protector 120 may be formed of a metal grid, whereas the upper visor portion 112 may be formed of the transparent polymeric material. In the embodiment shown, the face protector 120 defines two lateral openings O2 and two rear ribs 114*c*. The rear ribs 114*c* define rearmost edges of the face protector 120.

Referring to FIGS. 1-4, the openings O, O2 defined by the face protectors 20, 120 allow air expelled from the mouth of the wearer to pass through the face protectors 20, 120 to reach an environment E outside of a volume or space defined between the face of the wearer and the face protectors 20, 120. These openings O also allow air to enter the volume between the face of the wearer and the face protectors 20.

However, the wearer may have an illness, such as a respiratory illness, or be carrying and/or be infected by a virus that causes such an illness and may be contagious and transmitted by airborne particles, water droplets, saliva, etc., Alternately, the wearer may be healthy but playing with and/or may come in close contact with other players that are themselves carrying such a contagious illness. Such an illness or virus may include, for instance, influenza, SARS, SARS-CoV-2, COVID-19, and so on. The air flowing into and/or out of the openings O within the face protectors 20, 120 may, in such situations, contain undesired pathogens. The openings O through the face protectors 20, 120 may thus permit the transmission of such airborne pathogens to or from the wearer of the helmet 10. There is consequently a need to reduce the risk of such transmission. In order to permit players/wearers to participate more safely in a sporting activity (e.g. ice hockey, etc.) it would be desirable to reduce the air that is exhaled from the wearer from reaching the openings O and/or to ensure that the exhaled air that reaches the openings O is at least partially filtered in order to reduce the risk of transmission of such viruses between players.

Figure 5:
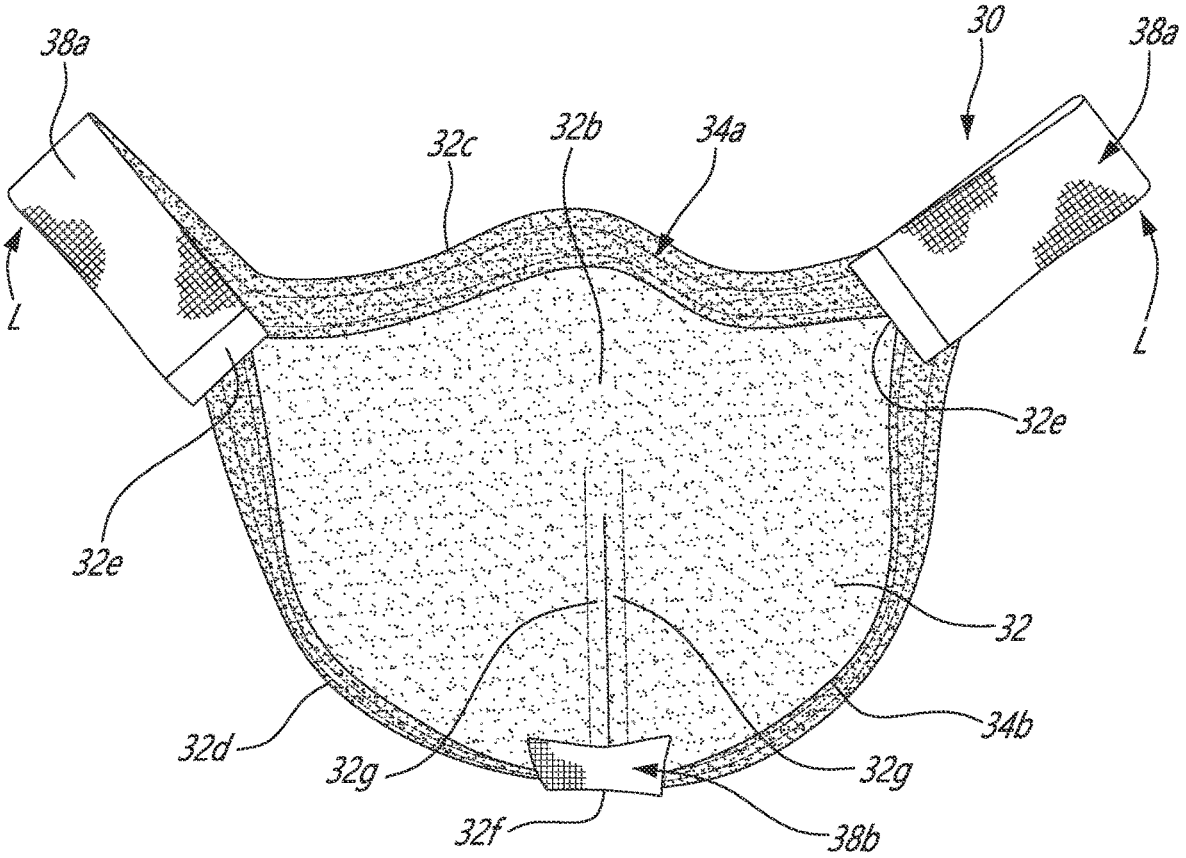
FIG. 5 is a front outer view of a face mask in accordance with one embodiment, the face mask being mountable to either of the face protectors of FIGS. 1 and 3.
Figure 6:
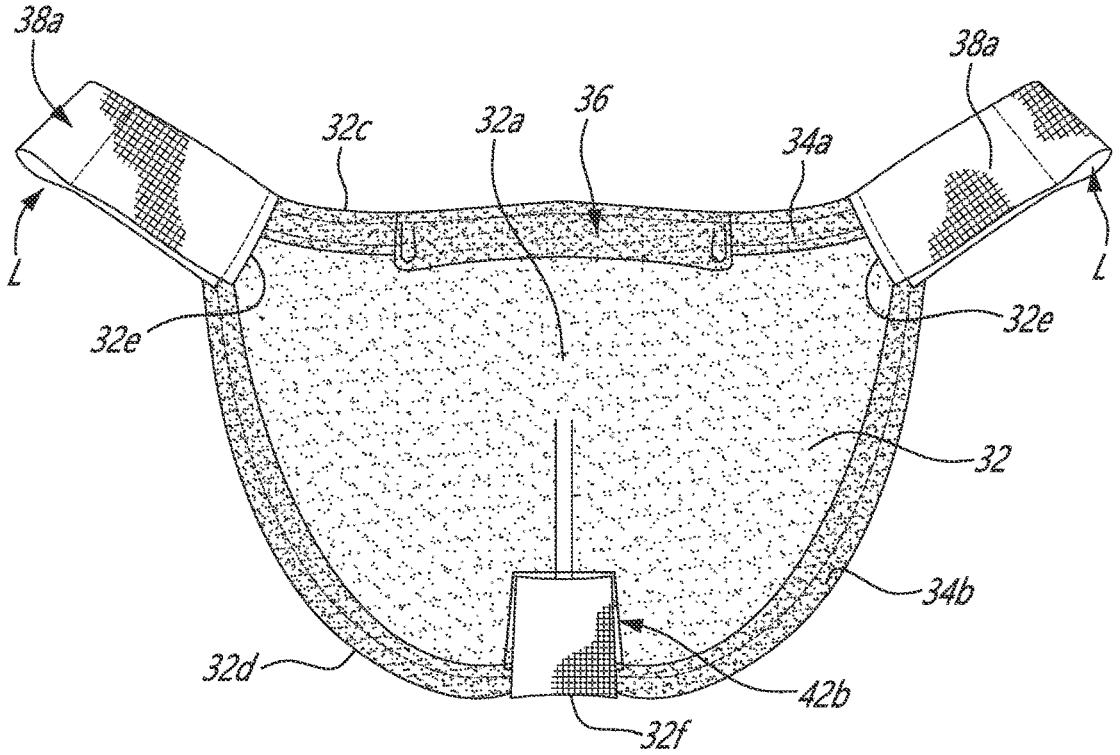
FIG. 6 is a rear inner view of the face mask of FIG. 5.
Figure 7:
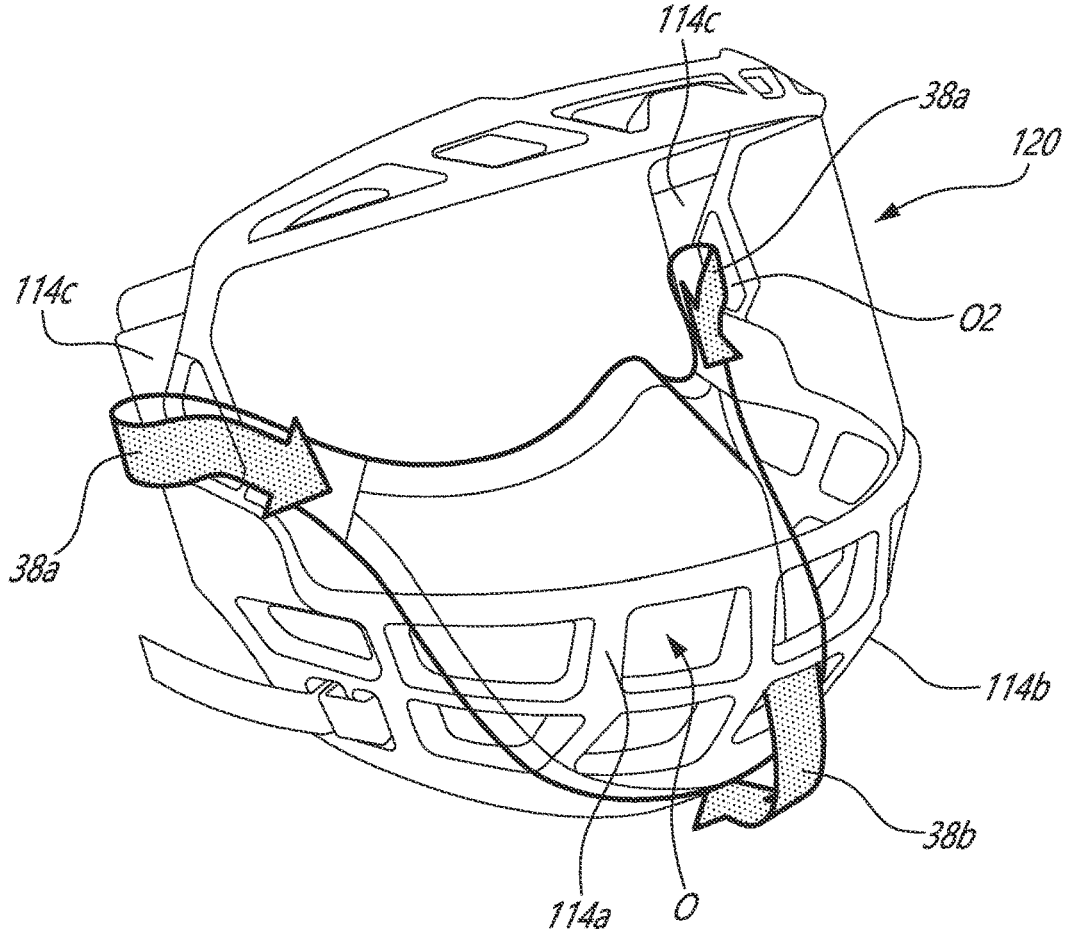
FIG. 7 is a schematic three-dimensional view of the face protector of FIG. 3 mounted to the face mask of FIG. 5.

Referring now to FIGS. 5 to 7, a face mask in accordance with one embodiment is shown generally at 30. The face mask 30, herein after simply "mask", is removably secured to the face protectors 20, 120 of the helmet 10 described above with reference to FIGS. 1-4. The face mask 30 is intended to limit the transmission of airborne pathogens (which may be present in the air exhaled from the wearer of the face mask) by at least partially blocking and/or redirecting airflow from the wearer, as will be described in further detail herein below.

The face masks 30, 130, 230, 330, 430, 530 as described herein are breath redirection masks, as opposed to masks which are intended principally to filter pathogens from airflow flowing therethrough, and thus the masks 30, 130, 230, 330, 430, 530 act to deviate the flow of air which is exhaled by the wearer (e.g., exhalation flow from the wearer) (see arrow A1 in FIG. 9 for example) rearwardly and thus away from the openings O defined through the face protectors 20, 120, 220. More particularly, the air exhaled by the wearer is received within a volume, or cavity, V which is formed and defined between the face masks 30, 130, 230, 330, 430, 530 and the mouth of the wearer. This volume V is herein defined by a shape of the masks that allows the mask to be free of contact with the mouth of the wearer. The masks 30, 130, 230, 330, 430, 530 are shaped to redirect the air exhaled by the wearer from his/her mouth toward gap(s) G defined between the face masks 30, 130, 230, 330, 430, 530 and a bottom portion of the face of the wearer. As will be explained below, the gap(s) G is/are oriented away from the face protectors 20, 120, 220, and hence away from openings O defined by said protectors 20, 120, 220. The gap(s) defines openings communicating with the volume V; the openings allowing air to enter/exit the volume V. The gap(s) G is/are defined between bottom portions and/or outer lateral edges of the masks 30, 130, 230, 330, 430, 530 and the face of the wearer and, more particularly, between the bottom and/or lateral edge(s) and/or the inner surface of the mask and the face of the wearer. Hence, the masks 30, 130, 230, 330, 430, 530 are designed such that bottom and/or lateral edges or sides are free of contact with the face of the wearer to define the gap(s) G via which the air may be outputted from the volume or space defined between the face of the wearer and the masks. The size, shape, location and/or orientation of the gap(s) G is chosen to redirect the air exhaled by the wearer towards lower and/or lateral edges of the mask, and thus towards exit openings defined between the mask and the cheeks and/or the chin of the wearer. Accordingly, the air exhaled by the wearer of the masks described herein is redirected by the mask away from other players to protect the other players from undesired pathogens that may be exhaled by the wearer of the mask 30, 130, 230, 330, 430, 530. Without the mask, the air would generally be exhaled by the wearer in a direction substantially perpendicular to the face of the wearer, and would be allowed to escape from within the face protector through the openings O defined by the face protectors 20, 120, 220, and towards the other players. The masks 30, 130, 230, 330, 430, 530 described herein may at least partially mitigate this phenomenon by redirecting the air exhaled by the wearer towards lower and/or lateral edges/sides of the face protector, the exhaled air therefore exits the volume V defined by the face mask in a direction that is oriented downwardly, laterally and/or rearwardly and away from the other players. This flow redirection may also help to prevent fogging of a clear face protector 120 (FIG. 3) which can otherwise occur if the heated exhaled air from the wearer were to flow perpendicularly outwardly and into the upper portions of the face protector 120. Moreover, the gap(s) G between the face masks 30, 130, 230, 330, 430, 530 and the face of the wearer may allow easy exhalation and inhalation of air from and to the wearer. In other words, the masks 30, 130, 230, 330, 430, 530 may provide for easier breathing for the wearer during effort (e.g., playing sports) compared to a regular medical face mask that contacts the face of the wearer around a whole perimeter of the regular medical face mask.

The material of the body 32 may be able to offer a flow resistance such that the exhalation flow A1 from the wearer is deviated towards the gaps G and away from the face protector. In other words, even if the material of the body 32 of the face mask has a degree of permeability to air, the exhalation flow A1 may follow a path of least resistance. In this case, the exhalation flow A1 may be diverted away from the face protector and towards the gap(s) G because it may be less restrictive for the exhalation flow to exit the volume V through the gap G than through the material of the body 32.

Referring more particularly to FIGS. 5-6, the mask 30 includes a body 32 having an inner side 32*a* facing toward a wearer of the helmet 10 and an outer side 32*b* opposed to the inner side 32*a* and facing away from the wearer. The body 32 of the mask 30 includes a top edge 32*c* and an opposed bottom edge 32*d*. In the embodiment shown, the top and bottom edges 32*c*, 32*d* meet at lateral ends 32*e* of the body 32. In the embodiment shown, the bottom edge 32*d* curves upwardly from a lower most and centered point 32*f* toward the lateral ends 32*e*. The top and bottom edges 32*c*, 32*d* of the body 32 of the mask 30 are covered by top and bottom bands of fabric 34*a*, 34*b*, which, in the embodiment shown, are stitched to the body 32 all around a perimeter of the body 32.

As shown in FIG. 5, the body 32 further defines two internal edges 32*g* that are stitched together along their lengths. These two internal edges 32*g* are defined by a dart and allows the body 32 of the mask 30 to have a three-dimensional shape upon the two internal edges 32*g* stitched together. In other words, the body 32 is substantially coplanar when the two internal edges 32*g* are not stitched together and spaced apart from one another. In order for the two internal edges 32*g* to be stitched to one another, the body 32 has to deform in a third dimension, out-of-plane, and provides the body 32 of the mask 30 with a "cup" shape suitable for receiving a portion of a face of the wearer. This is illustrated more distinctly in FIG. 7. The "cup" shape contributes in creating the volume V (FIG. 9) between the face mask 30 and the face of the wearer, more particularly between the face mask 30 and the mouth of the wearer. Ends of those two internal edges 32*g* may be aligned with a tip of a nose of the wearer such that the cup shape may matingly engage the nose of the wearer. This may avoid the mask 30 from exerting pressure on the nose of the wearer, which may be uncomfortable.

In the embodiment shown, the body 32 of the mask 30 is made of a material having one or more properties (such as a thickness, a stiffness, etc.) sufficient to allow the mask 30 to keep its three-dimensional shape while the wearer is breathing in an out, which may therefore prevent unwanted collapse of the mask (and thus of the gap defined between the mask and the wearer's mouth) which could otherwise be caused by inhalation. This relative structural rigidity of the mask 30 may be provided by the material selected for the body 32 and/or the method of forming the body. The body 32 may also include inner and outer layers spaced apart by a material, such as a mesh material, which may also provide a level of stiffness or rigidity to the mask 30 to prevent the mask from being suctioned toward the mouth of the user when the user is inhaling. Regardless of the manner with which it is achieved, this inherent rigidity of the mask 30 may help to maintain the cup shape of the face mask 30 during use. It will be appreciated that, alternatively or in combination, the body 32 of the mask 30 may be attached to the face protector 120 to maintain a spacing between the body 32 of the mask 30 and the mouth of the wearer. The inner and/or the outer layers may be treated with a waterproof treatment. The body 32 of the mask 30 may be made of neoprene. In an alternate embodiment, the mask 30 may be made of a material which is at least partially permeable to air, but able to filter out water droplets which could contain pathogens and thus prevent such water droplets from passing through the mask 30. In other words, the material of the mask 30 may be able to partially filter the air passing through to prevent pathogens from reaching the wearer or other players, however it is to be understood that flow redirection is the main purpose of the mask 30.

As shown in FIG. 6, a nose clip 36 is secured adjacent the top edge 32*c* of the body 32 of the face mask 30. The nose clip 36 is herein made of aluminum, but any other suitable material may be used. The nose clip 36 is deformable to follow a contour of a nose N (FIG. 9) of the wearer. Herein, "deformable" implies that the user is able to change a shape of the nose clip 36 and that the nose clip 36 is able to maintain the imparted shape. Deformable may imply a level of plastic deformation that allows the nose clip 36 to be deformed by the wearer from an original shape to a contoured or deformed shape and that allows the nose clip 36 to maintain the contoured or deformed shape even if no force is applied on the nose clip 36. As shown, the nose clip 36 is centered on the top edge 32*c*. In the present embodiment, the nose clip 36 is disposed on the inner side 32*a* of the body 32 of the face mask 32. The nose clip 36 contributes in having the face mask 32 more precisely follow the contours of the face of the wearer.

Referring to FIGS. 5 to 7, the mask 30 is secured to the face protector 120 (FIG. 7) using three straps, namely two lateral straps 38*a* and a bottom strap 38*b*. The straps 38*a*, 38*b* are shown in their fastened configuration in FIGS. 5-6. In their fastened configurations, the straps 38*a*, 38*b* define loops L sized to receive portions of the face protector 120. In the embodiment shown, each of the two lateral straps 38*a* is secured to a respective one of the two lateral ends 32*e* where the top and bottom edges 32*c*, 32*d* of the body 32 meet. The lateral straps 38*a* may have a length of about 115 mm whereas the bottom strap may have a length of 90 mm. The lateral and bottom straps 38*a*, 38*b* are here elastic.

Figure 8:
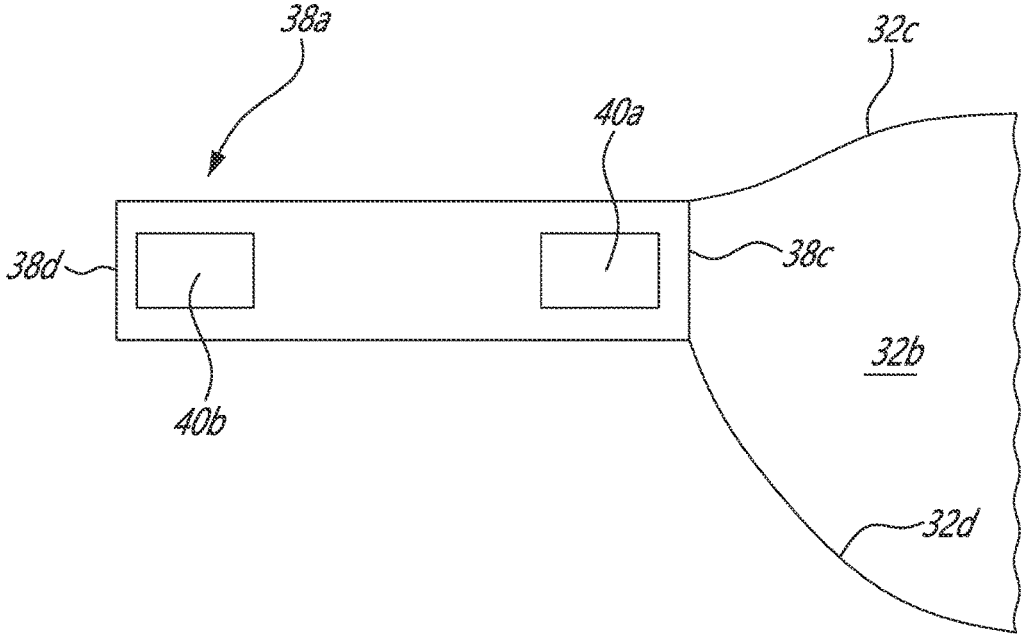
FIG. 8 is a schematic front outer view of a portion of the face mask of FIG. 5 illustrating one of lateral straps in an unfastened configuration.

Referring to FIG. 8, one of the lateral straps 38*a* is shown in an unfastened configuration. As shown, the lateral strap 38*a* has a proximal end 38*c* secured to the body 32 of the mask 30 and a distal end 38*d*. Each of the two lateral straps 38*a* has a first fastener 40*a* and a second fastener 40*b* removably securable to the first fasteners 40*a*. The lengths of the lateral straps 38*a* are selected to allow the straps 38*a* to wrap around portions of the face protector 120 and to allow the first and second fasteners 40*a*, 40*b* to be secured to one another. Herein, the first and second fasteners 40*a*, 40*b* are hook-and-loop fasteners. Lengths of the first and second fasteners 40*a*, 40*b* may be about 50 mm. The first and second fasteners 40*a*, 40*b* may be, alternatively, snap buttons or any other suitable fasteners.

As shown in FIG. 7, the mask 30 is disposed adjacent an inner side of the face protector 120 and is located between the face of the wearer and the face protector 120. The two lateral straps 38*a* wrap around the rear ribs 114*c* of the face protector 120 from the inner side to the outer side of the face protector 120 and penetrate the lateral openings O2 from the outer side back the inner side of the face protector 120 until the first and second fasteners 40*a*, 40*b* are in register. The first and second fasteners 40*a*, 40*b* are secured to one another to maintain a position of the mask 30 relative to the face protector 120.

Figure 9:
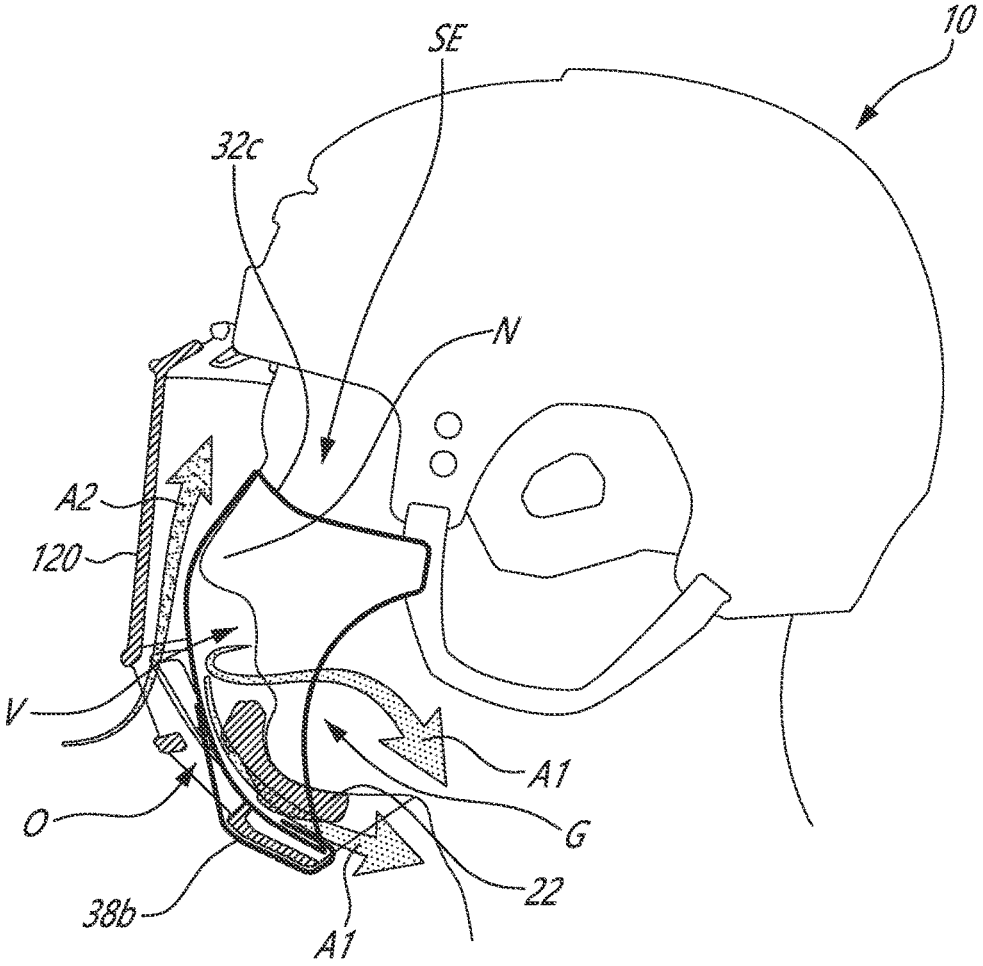
FIG. 9 is a schematic side, partially sectioned, view of the sports helmet of FIG. 1 and face protector of FIG. 3 equipped with the face mask of FIG. 5.

As illustrated in FIGS. 7 and 9, the two lateral straps 38*a* are used to pull the top edge 32*c* of the body 32 of the mask 30 in abutment against the face of the wearer. The top edge 32*c* therefore closely follows the shape of the face of the wearer to create a contact area SE between the top edge 32*c* of the mask 30 and the face of the wearer. The contact area SE limits air from flowing between the top edge 32*c* and the face of the wearer. In a particular embodiment, an at least partial sealing engagement is provided between the top edge 32*c* of the mask 30 and the face of the wearer. It will be appreciated that a certain quantity of air from the wearer may nevertheless still flow between the top edge 32*c* of the mask 30 and the face of the wearer at the contact area SE, and thus it is to be understood that such a partial "seal" or "sealing engagement" is not intended to be a perfect or full hermetic air seal. However, it will be appreciated that this certain quantity of air which will escape via the top edge 32*c* of the masks may be minimal compared to the air flowing via the gap G between the bottom edge 32*d* of the mask 30 and the face of the wearer. Accordingly, a major proportion of the air exhaled by the wearer will escape via the gap G and generally flow in a downward and rearward direction (as is schematically shown by arrows A1). In at least one embodiment, the portion of the exhaled air that is redirected via the gap G is at least greater than the air which may leak out from the top edge of the mask. In the embodiment shown, the top edge 32*c* of the body 32 of the mask 30 is biased against the face of the wearer thanks to the elasticity of the lateral straps 38*a* that pull the top edge 32*c* rearwardly against the face of the wearer and/or the intrinsic elasticity of the material forming at least this top edge 32*c* of the mask 30. It will be appreciated that the lateral straps 38*a* may be secured to any other suitable attachment points on the face protector 120 and/or helmet 10 as long as the lateral straps 38*a* are able to exert a biasing force between the top edge 32*c* of the mask 30 and the face of the wearer to create the contact area SE.

Figure 10:
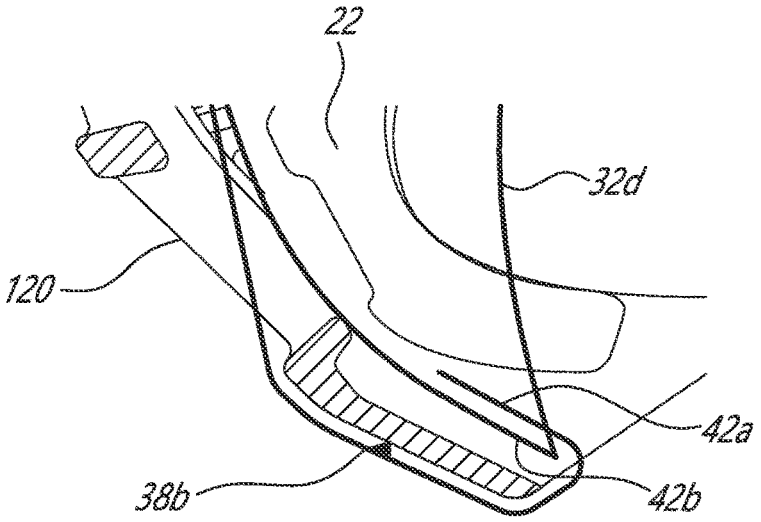
FIG. 10 is an enlarged cross-sectional view of a portion of FIG. 9 illustrating a fastening arrangement of a bottom portion of the face mask of FIG. 5 to the face protector of FIG. 3.

Referring now to FIGS. 9-10, the bottom strap 38*b* is secured to the outer side 32*b* of the body 32 of the mask at a location between the top and bottom edges 32*c*, 32*d*. The bottom strap 38*b* has a first fastener 42*a* secured to a distal end of the bottom strap 38*b*. The first fastener 42*a* is engageable to a second fastener 42*b* secured to the inner side 32*a* of the body 32 of the mask 30 and located proximate the bottom edge 32*d* of the body 32 of the mask 30.

As illustrated in FIG. 10, the bottom strap 38*b* extends from the outer side 32*b* of the body 32 of the mask 30 and extends through one of the openings O defined by the longitudinal and transverse ribs 114*a*, 114*b* (FIG. 3) of the face protector 120 from the inner side to the outer side of the face protector 120. Then, the strap 38*b* wraps around a bottom most portion of the face protector 120, herein a bottom-most one of the transverse ribs 114*b*, from the outer side back to the inner side of the face protector 120. Then, the distal end of the bottom strap 38*b* wraps around the bottom edge 32*d* of the body 32 of the mask 30 until the first and second fasteners 42*a*, 42*b* are in register.

As shown in FIGS. 9-10, the body 32 of the mask 30 is located between the face protector 120 and the chin cup 22. By so doing, gaps or spacing G are created between the bottom edge 32*d* of the body 32 of the mask 30 and the chin/mouth of the wearer. These gaps G are used to allow the wearer to breathe air in and out as depicted by the arrow A1. In other words, the gaps G define inlets and outlets for the air breathed and exhaled by the wearer.

When the wearer is wearing the helmet 10 with the face protector 120 and the mask 30, the air penetrates through the openings O defined by the face protector 120 as shown by arrow A2. The air is then deviated away from the nose N and mouth of the wearer thanks to mask 30 and contact area SE between the top edge 32*c* and the face of the wearer. The mask 30 may therefore protect the wearer against pathogens that may flow towards him/her during use. When the wearer exhales, the air is prevented from flowing out through the face protector 120 by the mask 30 and by the contact area SE between the top edge 32*c* and the face of the wearer. The mask 30 thereby acts as breath redirection mask and deviates the flow of exhaled air (arrow A1) towards the gaps G between the bottom edge 32*d* of the mask 30 and the cheeks of the wearer. The air exhaled by the wearer is therefore redirected away from the openings O and, therefore, away from the other players to protect the other players from undesired pathogens that may be exhaled by the wearer of the mask 30.

Figure 11:
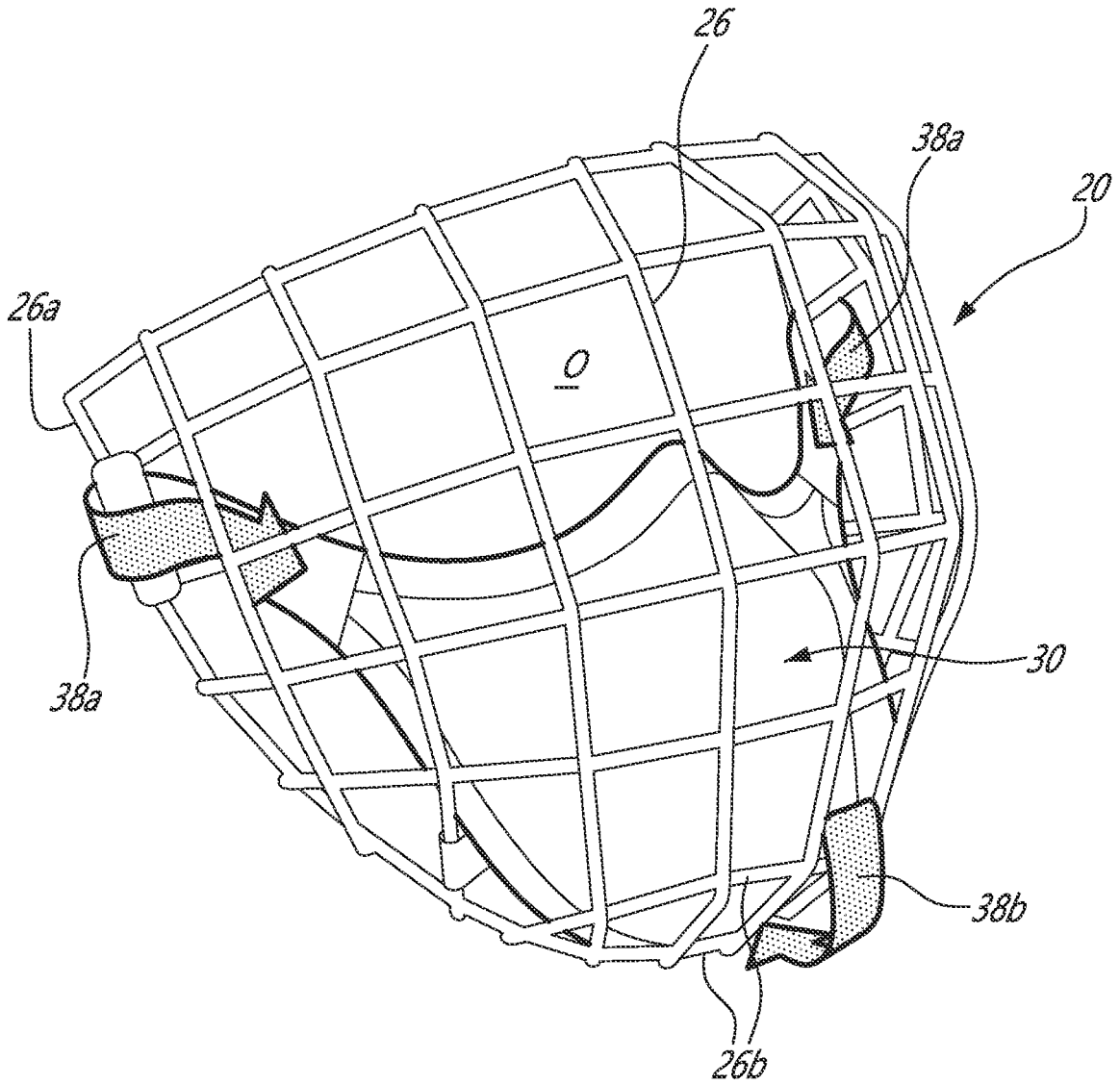
FIG. 11 is a schematic three-dimensional view of the face protector of FIG. 1 equipped with the face mask of FIG. 5.

Referring now to FIG. 11, the mask 30 is shown attached to the wire grid 26 of the face protector 20 of FIGS. 1-2. In the embodiment shown, the two lateral straps 38*a* are wrapped around the rearward most ones of the longitudinal wires 26*a* of the grid 26 whereas the bottom strap 38*b* is secured to the bottom most one of the transversal wires 26*b*.

In the embodiment shown, the lateral straps 38*a* extend from the inner side of the grid 26 to the outer side of the grid 26 and wraps around the longitudinal wires 26*a*. The lateral straps 38*a* then extend through the openings O defined by the wires 26*a*, 26*b* and from the outer side back to the inner side of the grid 26 until the first and second fasteners 40*a*, 40*b* (FIG. 8) are in register. The bottom strap 38*b* is secured as described above with reference to FIG. 10. It will be appreciated that the lateral straps 38*a* may be secured to any other suitable attachment points on the face protector 20 and/or helmet 10 as long as the lateral straps 38*a* are able to exert a biasing force between the top edge 32*c* of the mask 30 and the face of the wearer to create the contact area SE.

Referring now to FIGS. 12-15, another embodiment of a face mask is shown generally at 130. The face mask 130 is more particularly suited to be secured to a goalie helmet 100 (FIG. 14) having a face protector 220 including a wire grid 226.

Figure 12:
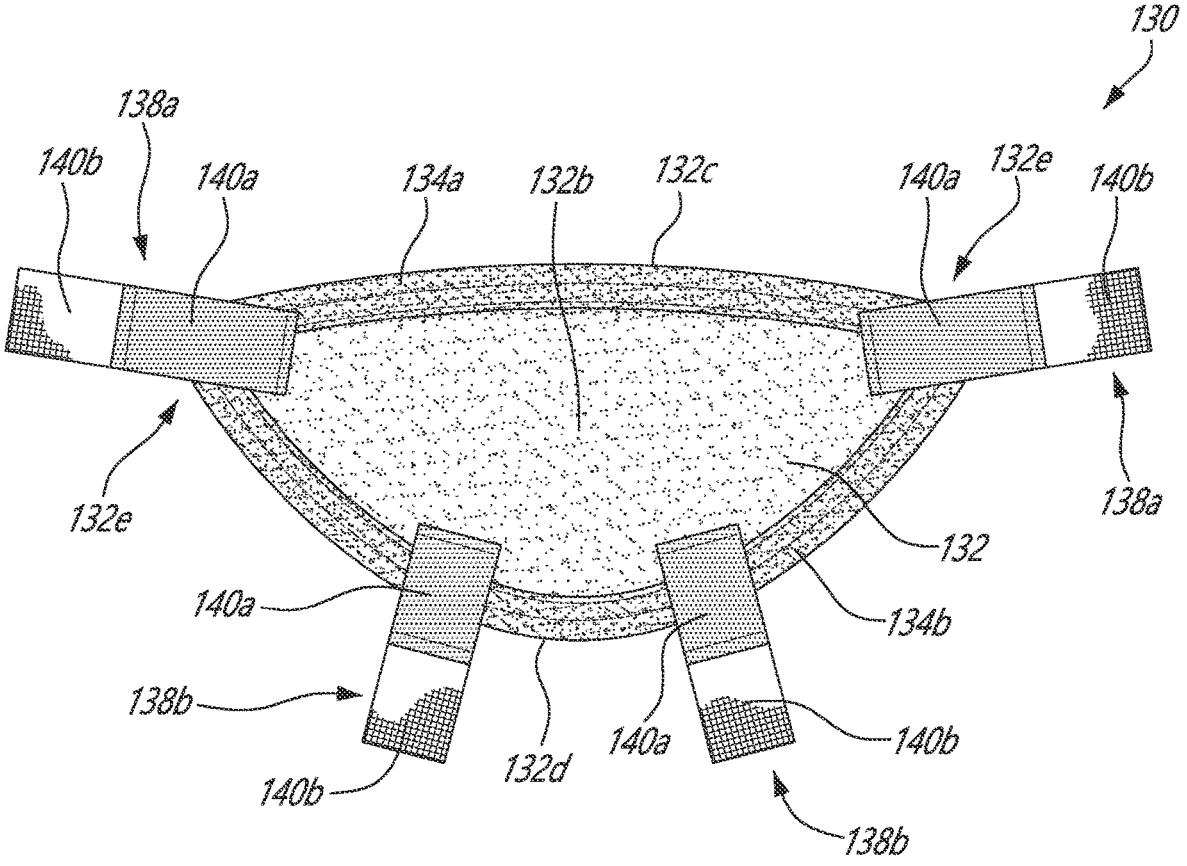
FIG. 12 is a front outer view of a face mask in accordance with another embodiment.
Figure 13:
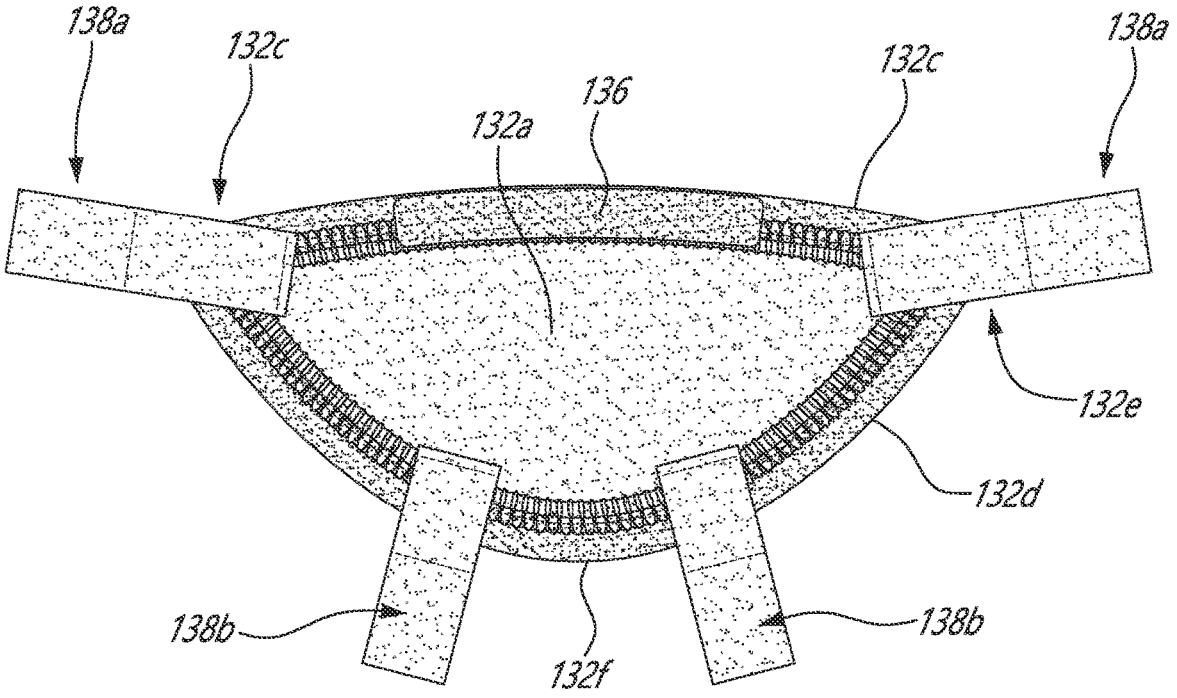
FIG. 13 is a rear inner view of the face mask of FIG. 12.

Referring more particularly to FIGS. 12-13, the mask 130 includes a body 132 having an inner side 132*a* facing toward a wearer of the helmet 100 and an outer side 132*b* opposed to the inner side 132*a* and facing away from the wearer. The body 132 of the mask 130 includes a top edge 132*c* and an opposed bottom edge 132*d*. In the embodiment shown, the top and bottom edges 132*c*, 132*d* meet at lateral ends 132*e* of the body 132. In the embodiment shown, the bottom edge 132*d* curves upwardly from a lower most and centered point 132*f* toward the lateral ends 132*e*. The top and bottom edges 132*c*, 132*d* of the body 132 of the mask 130 are covered by top and bottom bands of fabric 134*a*, 134*b*, which, in the embodiment shown, are stitched to the body 132 all around a perimeter thereof. It will be appreciated that the dimensions illustrated on FIG. 12 are exemplary only and other dimensions are contemplated. Any suitable material for the body 132 of the mask 130, such as neoprene, is contemplated.

As shown in FIG. 13, a nose clip 136 is secured to the top edge 132*c* of the body 132 of the face mask 130. The nose clip 136 is herein made of aluminum, but any other suitable material may be used. The nose clip 136 is similar to the nose clip 36 described above with reference to FIG. 6.

Figure 14:
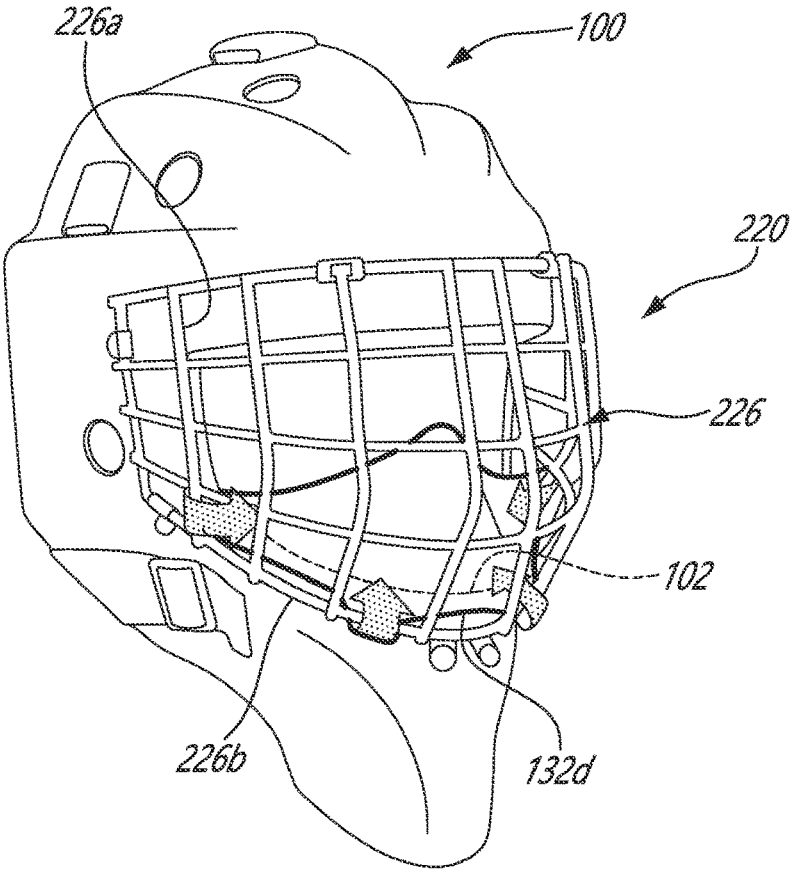
FIG. 14 is a schematic three-dimensional view of a goalie helmet equipped with the face mask of FIG. 12.

Referring to FIGS. 12 to 14, the mask 130 is secured to the grid 226 (FIG. 14) using four straps, namely two lateral straps 138*a* and two bottom straps 138*b*. In the embodiment shown, each of the two lateral straps 138*a* is secured to a respective one of the two lateral ends 132*e* where the top and bottom edges 132*c*, 132*d* meet. The bottom straps 138*b* are secured to the bottom edge 132*d* proximate and on opposite sides of the lower-most and centered point 132*f*. The lateral and bottom straps 138*a*, 138*b* are herein made of a substantially non-extensible fabric. Alternatively, the straps 138*a*, 138*b* may be made of an elastic material.

Referring more particularly to FIG. 12, each of the two lateral and the two bottom straps 138*a*, 138*b* includes a first fastener 140*a* and a second fastener 140*b* removably securable to the first fastener 140*a*. These first and second fasteners 140*a*, 140*b* may be, for instance, hook-and-loop fasteners, but any other suitable fasteners may be used.

As shown in FIG. 14, the mask 130 is disposed adjacent an inner side of the face protector 220 and is located between the face of the wearer and the face protector 220. Each of the two lateral straps 138*a* wraps around a respective one of two longitudinal wires 226*a* of the grid 226 from the inner side to the outer side of the face protector 220 and penetrates a respective one of two openings O from the outer side back the inner side of the face protector 220 until the first and second fasteners 140*a*, 140*b* are in register. The first and second fasteners 140*a*, 140*b* are then secured to one another to maintain a position of the mask 130 relative to the face protector 220. Similarly, each of the two bottom straps 138*b* wraps around a bottom most one of transversal wires 226*b* of the grid 226 from the inner side to the outer side of the face protector 220 and penetrates a respective one of two other openings O from the outer side back to the inner side of the face protector 220 until the first and second fasteners 140*a*, 140*b* are in register. The first and second fasteners 140*a*, 140*b* are then secured to one another to maintain a position of the bottom edge 132*d* of the body 132 of the mask 130 relative to the face protector 220. It will be appreciated that the lateral straps 138*a* may be fastened at any suitable place so long as a biasing force is exerted between the top edge of the face mask 130 and the face of the wearer.

Still referring to FIG. 14, an overlap is created between the bottom edge 132*d* of the body 132 of the mask 130 and a bottom edge 102 (tiered line) that defines an opening of the helmet 100; the face protector 220 therefore covers a bottom portion of such opening. This overlaps ensures that there is no gap between the face mask 130 and the bottom edge 102 of the helmet 100. In other words, the overlap is used to ensure that air is limited from flowing through the lower openings O of the grid 226 that are aligned with the nose and mouth of the wearer.

Figure 15:
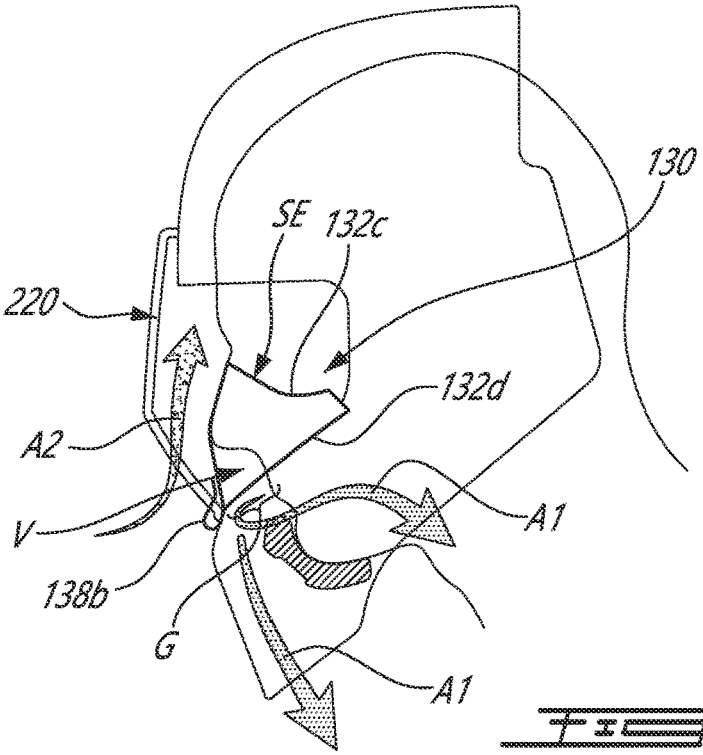
FIG. 15 is a schematic side, partially sectioned view of the helmet of FIG. 14 equipped with the face mask of FIG. 12.

Referring more particularly to FIG. 15, a volume V is defined between the face mask 130 and the face of the wearer and a gap G, which communicates with the volume V, is created between a bottom portion of the face of the wearer (e.g., mouth) and the bottom edge 132*d* of the body 132 of the face mask 130. This gap G is created by securing said bottom edge 132*d* to the bottom most one of the transversal wire 226*b* of the grid 226 of the face protector 220. As discussed herein above, the air exhaled by the wearer is received within the volume V and redirected away from the openings O towards the gap G. The air exhaled by the wearer is able to flow out of the volume V between the face mask 130 and the face of the wearer via the gap G following arrows A1.

As described above, the two lateral straps 138*a* are used to pull the top edge 132*c* of the body 132 of the mask 130 in abutment against the face of the wearer. The top edge 132*c* therefore closely follows a shape of the face of the wearer to create a contact area SE between the top edge 132*c* of the mask 130 and the face of the wearer. The contact area SE limits air from flowing between the top edge 132*c* and the face of the wearer. In the embodiment shown, the top edge 132*c* of the body 132 of the mask 130 is biased against the face of the wearer thanks to the of the lateral straps 138*a* that pull the top edge 132*c* rearwardly against the face of the wearer.

When the wearer is wearing the helmet 100 with the face protector 220 and the mask 130, the air penetrates through the openings O defined by the face protector 220 as shown by arrow A2. The air is then deviated away from the nose and mouth of the wearer thanks to mask 130 and contact area SE between the top edge 132*c* and the face of the wearer. The mask 130 may therefore protect the wearer against pathogens that may flow towards him/her during use. When the wearer exhales, the air is prevented from flowing substantially perpendicularly outwardly through the face protector 220 by the mask 130 and by the contact area SE between the top edge 132*c* and the face of the wearer. The mask 130 thereby acts as breath redirection mask and deviates the flow of exhaled air (arrow A1) received within the volume V towards the gap G between the bottom edge 132*d* of the mask 130 and the bottom portion of the face of the wearer. The exhaled air is therefore redirected in another direction besides a perpendicularly outward one and, thus, away from the most direct contamination path with other players.

It will be appreciated that both of the face masks 30, 130 are attached solely to the helmet 10, 100, more particularly to the face protectors 20, 120, 220, and are herein free of attachment to the wearer. This allows the wearer to remove the helmet 10, 100, or to pivot the face protector 20, 120, 220 integrally with the face masks 30, 130. Therefore, the face masks 30, 130 have to be adjusted to the contour of the wearer only once to create the afore discussed contact area SE. Putting the helmets 10, 100 on will, simultaneously, adjust the face masks 30, 130 in the desired position to suitably protect the wearer and other players from unwanted pathogens. Stated differently, once the face masks 30, 130 are suitably adjusted to the shape of the wearer, very little action is required by the wearer when he or she puts on or removes the helmet 10, 100 (or pivots the face protector 20, 120, 220).

Figure 16:
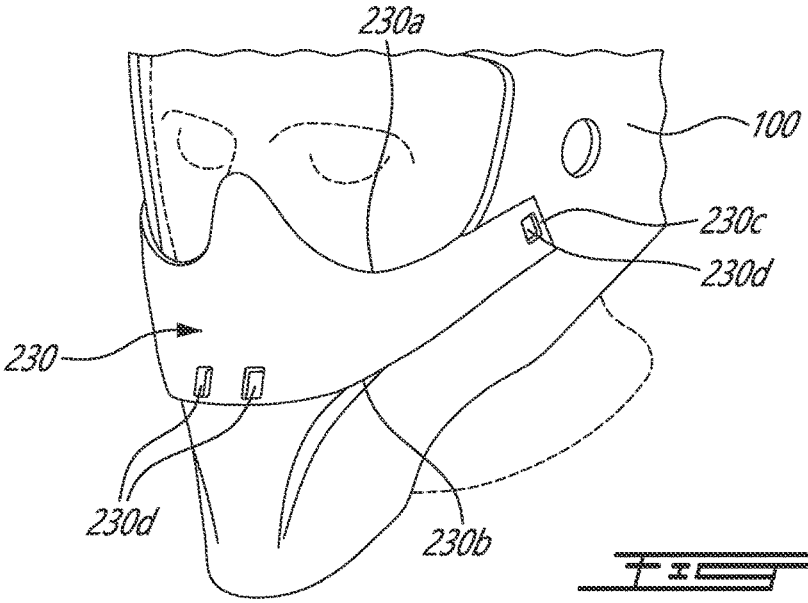
FIG. 16 is a schematic three-dimensional view of the helmet of FIG. 14 equipped with a face mask in accordance with another embodiment, shown with the eye-protecting wire grid removed.

Referring now to FIG. 16, another embodiment of a face mask for the helmet 100 is shown generally at 230. The facemask 230 has a top edge 230*a* that follows a shape of the face of the wearer and a bottom edge 230*b* affixed on the outer side of the helmet 100. The facemask 230 has two lateral edges 230*c* each affixed to a respective one of lateral sides of the helmet 100. In the embodiment shown, the face mask 230 defines apertures 230*d* that register with apertures defined through the helmet 100 and that are used for attaching the grid 226 (FIG. 14) to the helmet 100. In other words, the face mask 230 leverages apertures already present on the helmet 100. The top edge 230*a* has a central portion protruding upwardly from a remainder of the top edge 230*a* and adapted to cover the nose of the wearer. As previously discussed, a contact area is defined between the top edge 230*a* and the nose of the wearer. The bottom edge 230*b* of the face mask 230 is sandwiched between the helmet 100 and the grid 226.

Figure 17:
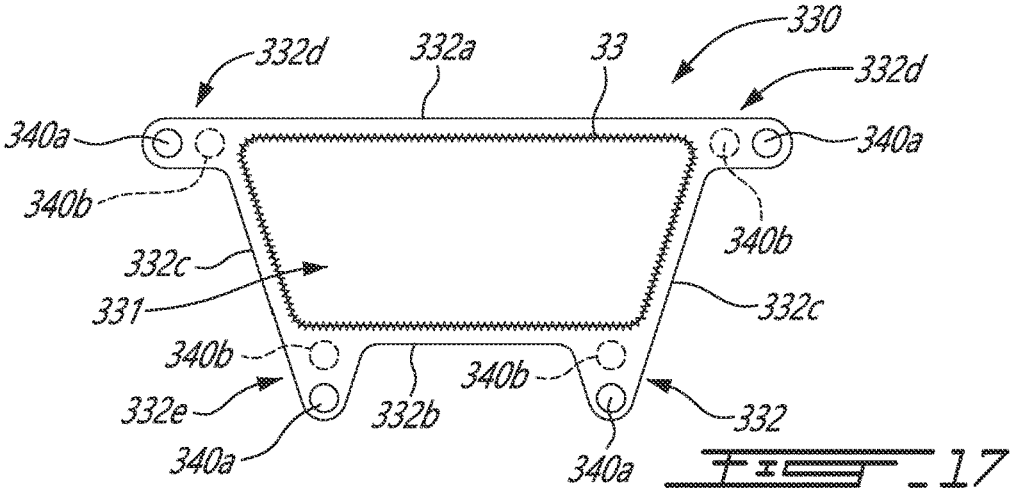
FIG. 17 is a schematic plan view of a face mask in accordance with another embodiment.
Figure 18:
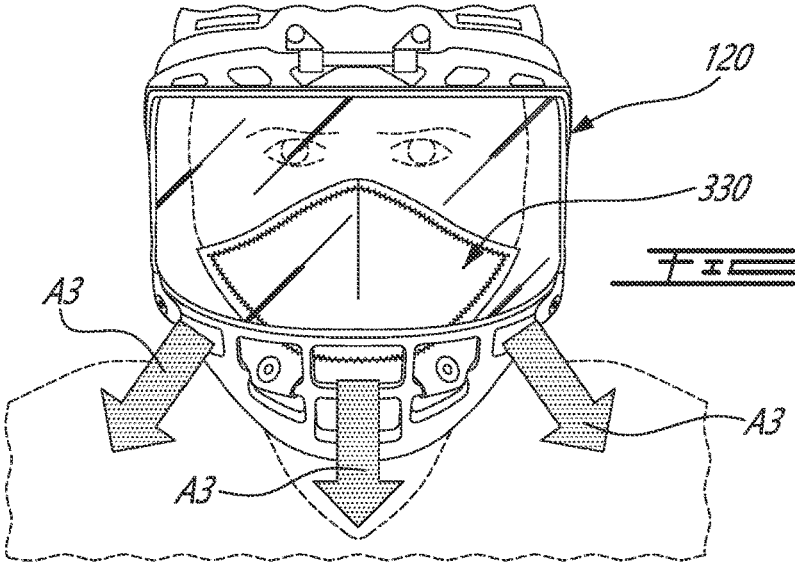
FIG. 18 is a schematic front three-dimensional view of the helmet of FIG. 1 equipped with the face protector of FIG. 3 and the face mask of FIG. 17.

Referring now to FIGS. 17-18, another embodiment of a face mask is shown generally at 330. The face mask 330 is adapted to be secured to the face protector 120 described above with reference to FIGS. 3-4.

The face mask 330 has a central portion 331 and a peripheral portion 332 disposed around the central portion 331. The peripheral portion 332 defines top, bottom, and lateral edges 332*a*, 332*b*, 332*c* of the mask 330. The central portion 331 may be made of a mesh material, or may be made of a transparent plastic material. The peripheral portion 332 may be made of a soft material, which may be elastic and which may be non-irritant for the skin of the wearer. The central portion 331 is herein stitched to the peripheral portion 332.

The peripheral portions 332 defines two top lateral straps 332*d* and two bottom straps 332*e*. Each of the top lateral and bottom straps 332*d*, 332*e* is sized to wrap around the ribs 114*a*, 114*b* (FIG. 3) of the face protector 120. The straps 332*d*, 332*e* define first fasteners 340*a* at distal ends thereof and second fasteners 340*b* at proximal ends thereof engageable and removably securable to the first fasteners 340*a*. By being secured to the ribs, a gap is created between the bottom edge 332*b* of the face mask 330 and the face of the wearer. This gap allows the air exhaled by the wearer to exit the space defined between the face of the wearer and the mask 330 and allows air to enter said space to allow the wearer to breathe.

As shown in FIG. 18, the face mask 330 acts as a breath redirector and deflects air exhaled by the wearer downwardly along arrows A3 via the gap. By so doing, the air exhaled by the wearer is not projected towards other players. Similarly, the air from the other players is deflected away from the nose and mouth of the wearer by the face mask 330.

It will be appreciated that the masks 30, 130, 230, 330, 430, 530 may be made of a rigid plastic material shaped to follow the contour of the face of the user. It will be further appreciated that other attachment points of the masks 30, 130, 230, 330, 430, 530 to the helmets 10, 100 and/or face protectors 20, 120, 220 are contemplated. More or less attachment points may be used. The helmet and/or face protectors may be modified to incorporate mating fasteners suitable to secure the face masks 30, 130, 230, 330, 430, 530 to the helmet 10, 100 and/or face protectors 20, 120, 220. A face mask may be used with a helmet equipped with a half-visor, that is a visor that does not cover the chin of the wearer. In such a case, a contact area between the top edge of the mask and the face of the wearer is still provided and the bottom edge of the mask may be cantilevered and free of attachment to the helmet/user. A certain degree of rigidity may be required to ensure that the wearer does not suction the mask while breathing and to ensure that the mask keeps its position and orientation relative to the face of the user.

Figure 19:
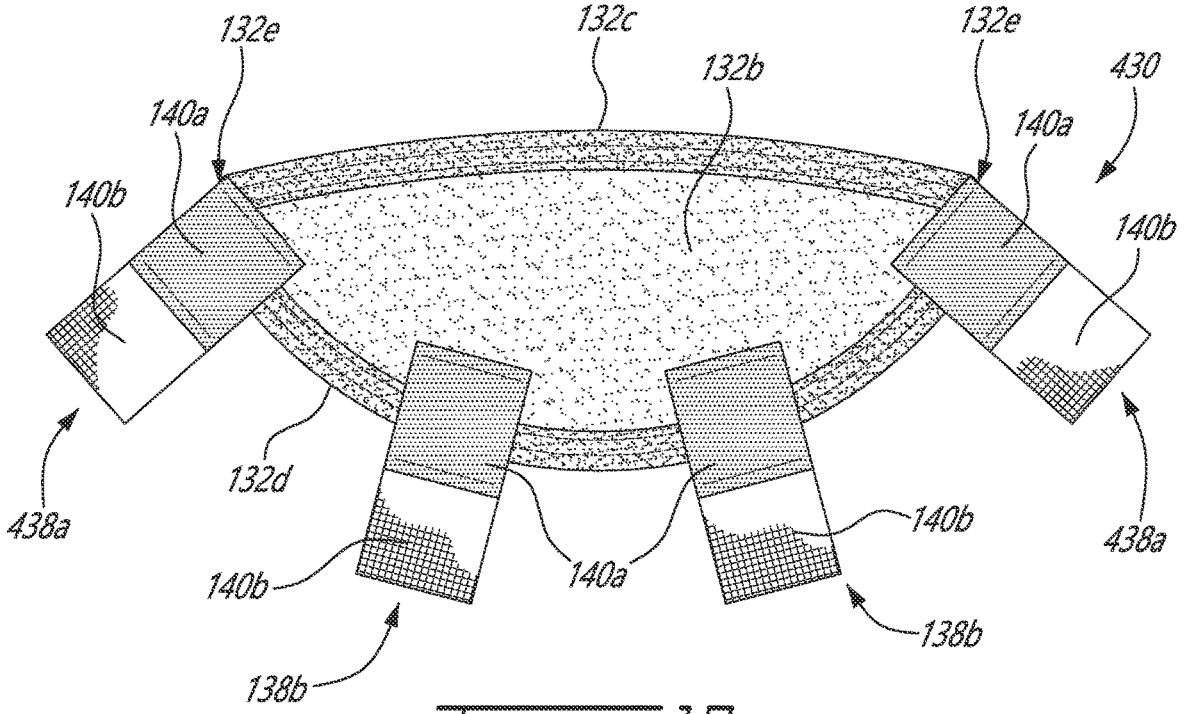
FIG. 19 is a front outer view of a face mask in accordance with another embodiment.
Figure 20:
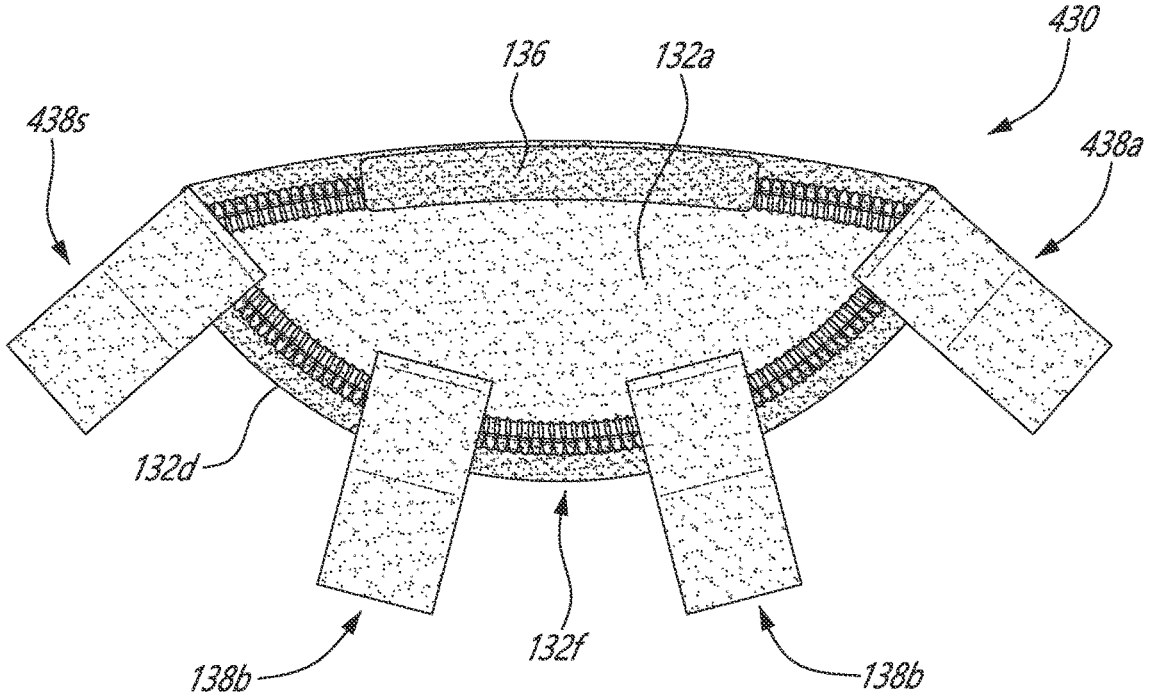
FIG. 20 is a rear inner view of the face mask of FIG. 19.

Referring now to FIGS. 19-20, another embodiment of a face mask is shown at 430. For the sake of conciseness, only elements that differ from the face mask 130 described above with reference to FIGS. 12-13 are described below.

The mask 430 is secured to the grid 226 (FIG. 21) using four straps, namely two lateral straps 438*a* and two bottom straps 138*b*. In the embodiment shown, each of the two lateral straps 438*a* is secured to a respective one of the two lateral ends 132*e* where the top and bottom edges 132*c*, 132*d* meet. The two lateral straps 438*a* extend from the lateral ends 132*e* downwardly away from the top edge 132*c*. The bottom straps 138*b* are secured to the bottom edge 132*d* proximate and on opposite sides of the lower-most and centered point 132*f*. The lateral and bottom straps 138*a*, 138*b* are herein made of a substantially non-extensible fabric. Alternatively, the straps 138*a*, 138*b* may be made of an elastic material.

Referring more particularly to FIG. 19, each of the two lateral and the two bottom straps 138*a*, 138*b* includes a first fastener 140*a* and a second fastener 140*b* removably securable to the first fastener 140*a*. These first and second fasteners 140*a*, 140*b* may be, for instance, hook-and-loop fasteners, but any other suitable fasteners may be used.

Figure 21:
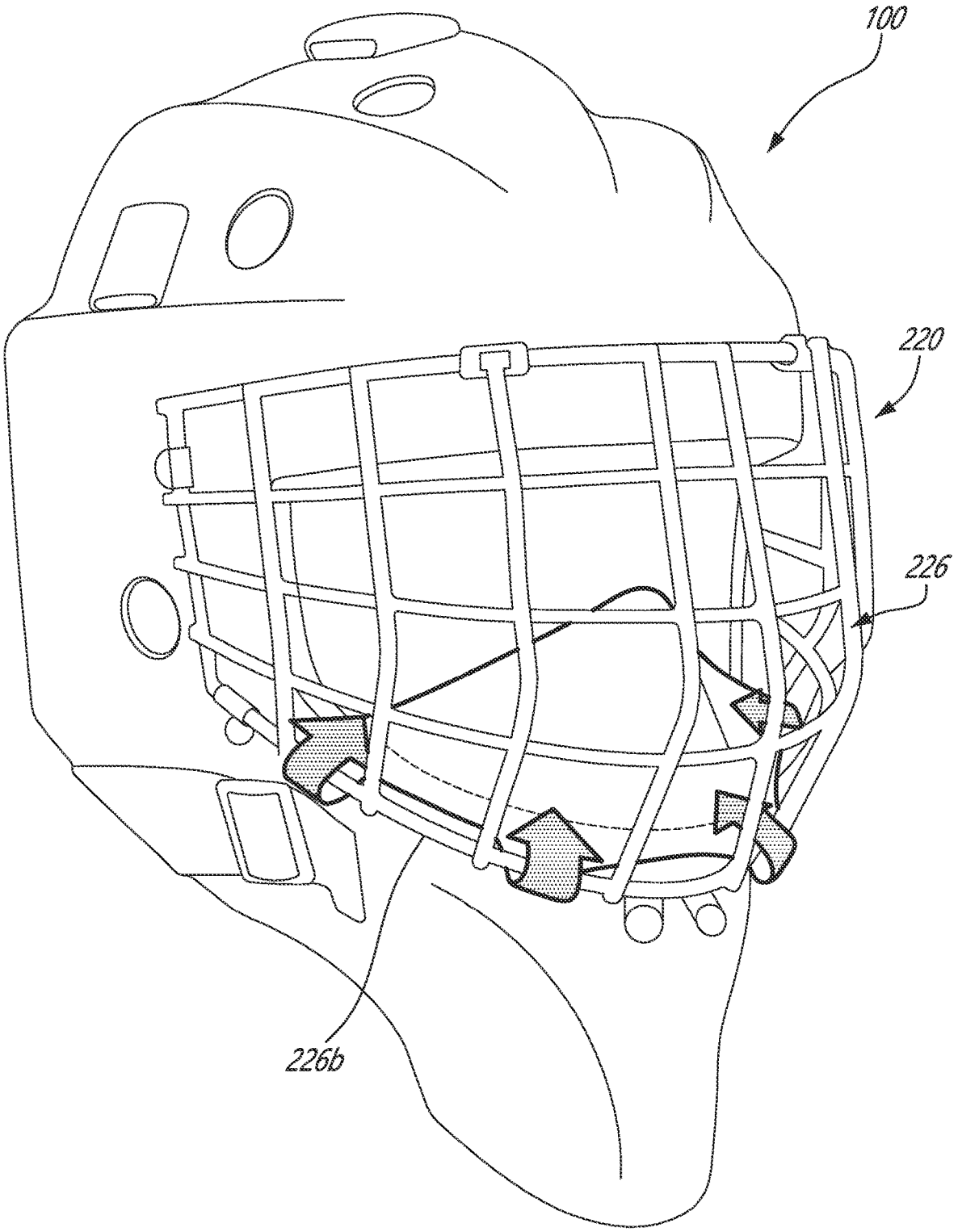
FIG. 21 is a schematic three-dimensional view of a goalie helmet equipped with the face mask of FIG. 19.

As shown in FIG. 21, the mask 430 is disposed adjacent an inner side of the face protector 220 and is located between the face of the wearer and the face protector 220. Each of the two lateral straps 438*a* wraps around a bottom most one of the transversal wires 226*b* of the grid 226 from the inner side to the outer side of the face protector 220 and penetrates a respective one of two openings O from the outer side back the inner side of the face protector 220 until the first and second fasteners 140*a*, 140*b* are in register. The first and second fasteners 140*a*, 140*b* are then secured to one another to maintain a position of the mask 130 relative to the face protector 220. Similarly, each of the two bottom straps 138*b* wraps around the bottom most one of the transversal wires 226*b* of the grid 226 from the inner side to the outer side of the face protector 220 and penetrates a respective one of two other openings O from the outer side back to the inner side of the face protector 220 until the first and second fasteners 140*a*, 140*b* are in register. The first and second fasteners 140*a*, 140*b* are then secured to one another to maintain a position of the bottom edge 132*d* of the body 132 of the mask 130 relative to the face protector 220. It will be appreciated that the lateral straps 138*a* may be fastened at any suitable place so long as a biasing force is exerted between the top edge of the face mask 130 and the face of the wearer.

The two lateral straps 438*a* are used to pull the top edge 132*c* of the body 132 of the mask 130 in a downward direction and abutment against the face of the wearer. The top edge 132*c* therefore closely follows a shape of the face of the wearer to create a contact area SE between the top edge 132*c* of the mask 430 and the face of the wearer. The contact area SE limits air from flowing between the top edge 132*c* and the face of the wearer. In the embodiment shown, the top edge 132*c* of the body 132 of the mask 430 is biased against the face of the wearer thanks to the lateral straps 438*a* that pull the top edge 132*c* downwardly against the face of the wearer.

It will be appreciated that the lateral straps may be attached to the helmet, as opposed to the face protector, as long as a suitable biasing force against the face of the wearer is exerted by the top edge of the mask. Furthermore, in circumstances where the bottom strap(s) does not have a suitable anchor point to attach itself to and create volume V between the face mask and the face of the wearer, as well as gap(s) G for exhaled air to flow out through (as will be shown in the alternative embodiment below of a helmet with a half-visor), a rigid lower portion of the mask may be used to create (and maintain) the gap G and volume V during use. Such rigid lower portion may be a shaped PVC part. However, it the face mask's material is already sufficiently rigid to maintain the desired shape (Gap G/Volume V), no specific construction will be necessary.

Referring now to FIGS. 22-25, another embodiment of a face mask is shown generally at 530. The face mask 530 is meant to be equipped with the helmet 10 of FIG. 1 when said helmet 10 is equipped with a half-visor 320 (FIG. 24) that typically covers the eyes of the wearer and part of the nose of the wearer. With such a half-visor 320, the mouth of the wearer is usually fully exposed and, therefore, air exhaled by the wearer may flow unimpeded toward other players, which is not desired.

Figure 22:
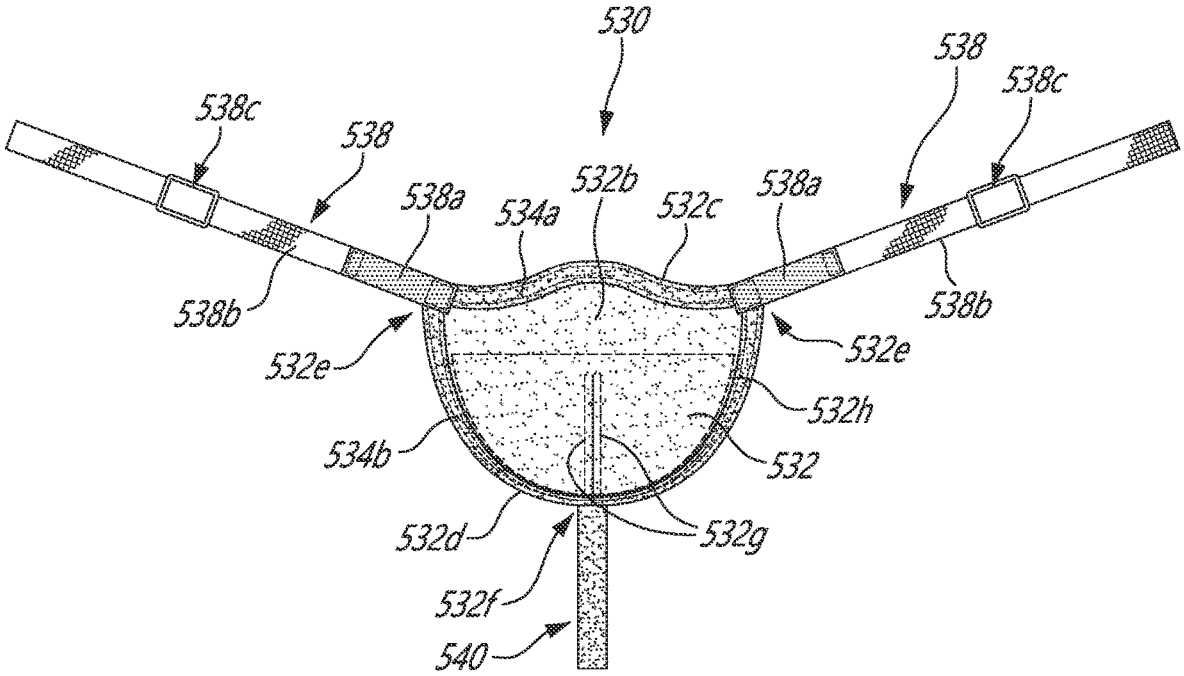
FIG. 22 is a front outer view of a face mask in accordance with one embodiment.
Figure 23:
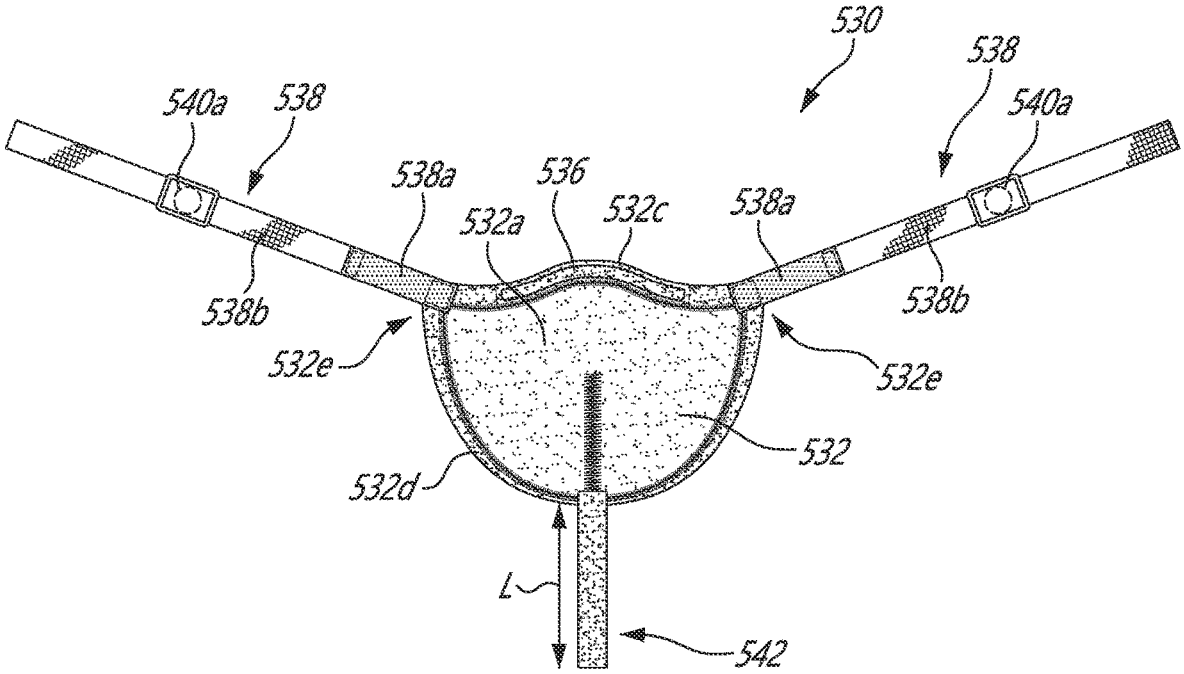
FIG. 23 is a rear inner view of the face mask of FIG. 22.

Referring more particularly to FIGS. 22-23 the mask 530 includes a body 532 having an inner side 532*a* facing toward a wearer of the helmet 10 and an outer side 532*b* opposed to the inner side 532*a* and facing away from the wearer. The body 532 of the mask 530 includes a top edge 532*c* and an opposed bottom edge 532*d*. In the embodiment shown, the top and bottom edges 532*c*, 532*d* meet at lateral ends 532*e* of the body 532. In the embodiment shown, the bottom edge 532*d* curves upwardly from a lower most and centered point 532*f* toward the lateral ends 532*e*. The top and bottom edges 532*c*, 532*d* of the body 532 of the mask 530 are covered by top and bottom bands of fabric 534*a*, 534*b*, also referred to as binding, which, in the embodiment shown, are stitched to the body 532 all around a perimeter of the body 532. The binding 534*a*, 534*b* are herein made of polyester. In the embodiment shown, the body 532 includes a neoprene core having its two opposed sides laminated with a 100% polyester fabric. The thickness of the body 532 is about 2 mm.

As shown in FIG. 22, the body 532 further defines two internal edges 532*g* that are stitched together along their lengths. These two internal edges 532*g* are defined by a dart and allows the body 532 of the mask 530 to have a three-dimensional shape upon the two internal edges 532*g* stitched together. In other words, the body 532 is substantially co-planar when the two internal edges 532*g* are not stitched together and spaced apart from one another. In order for the two internal edges 532*g* to be stitched to one another, the body 532 has to deform in a third dimension and provides the body 532 of the mask 530 with a "cup" shape suitable for receiving a portion of a face of the wearer. This is illustrated more distinctly in FIG. 24. The "cup" shape contributes in creating the volume V (FIG. 25) between the face mask 530 and the face of the wearer, more particularly between the face mask 530 and the mouth of the wearer.

As shown in FIG. 23, a nose clip 536 is secured adjacent the top edge 532*c* of the body 532 of the face mask 530. The nose clip 536 is herein made of aluminum, but any other suitable material may be used. As shown, the nose clip 536 is centered on the top edge 532*c*. In the present embodiment, the nose clip 536 is disposed on the inner side 532*a* of the body 532 of the face mask 532. The nose clip 536 contributes in having the face mask 532 more precisely follow the contours of the face of the wearer. The nose clip 536 has herein a length of about 90 mm, a width of about 5 mm, and a thickness of about 0.5 mm. The nose clip 536 is located inside the binding 534*a*.

Figure 24:
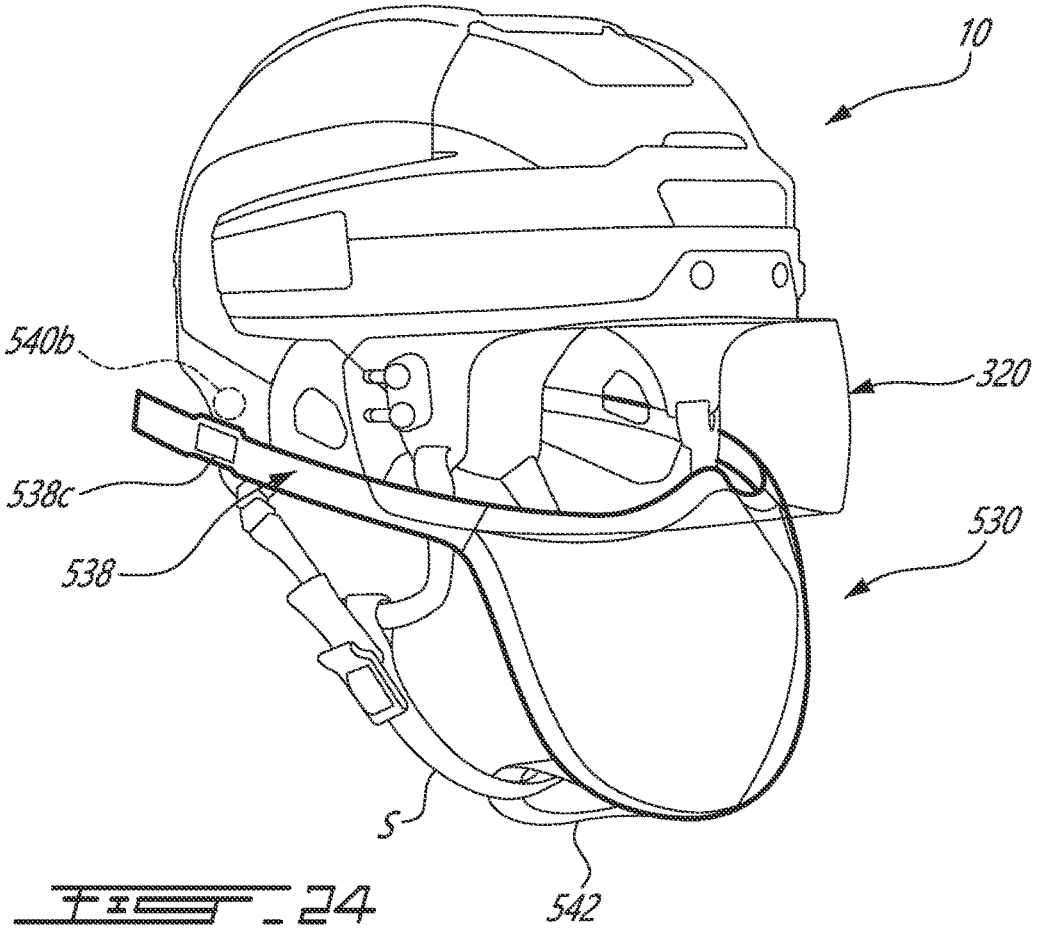
FIG. 24 is a schematic three-dimensional view of the helmet of FIG. 1 equipped with a half-visor and with the face mask of FIG. 22.

Referring to FIGS. 22 to 24, the mask 530 is secured to the helmet 10 using two straps, namely two lateral straps 538. Each of the two lateral straps 538 includes an elastic strap portion 538*a* secured to the lateral ends 532*e* and a webbing strap portion 538*b* secured to a distal end of the elastic strap portion 538*a*. Box stitches are herein used to secure the elastic strap portions 538*a* to the body 532 and to secure the webbing strap portions 538*b* to the elastic strap portions 538*a*. Any suitable securing means for the straps may alternatively be used. Snap buckles 538*c* are secured to the webbing strap portions 538*b*. Each of the snap buckles 538*c* defines a first fastener 540*a* matingly and removably engageable to a second fastener 540*b* (FIG. 24) that is herein secured on the left and right sides of the helmet 10. The snap buckles 538*c* are used to vary an effective length L of the lateral straps 538. The effective length extends from the lateral ends 532*e* of the body of the mask 530 to the snap buckles 538*c*. The second fasteners 540*b* of the helmet 10 are typically present on the helmet 10 and are designed to be used for securing a full cage or visor (e.g., face protector 20, 120 of FIGS. 1 and 3) to the helmet 10. The snap buckles 538*c* are herein 0.5 inch snap buckles.

It will be appreciated that the mask 530 may be secured to the helmet 10 in any suitable fashion. For instance, the lateral straps 538 may wrap around the helmet 10 and be secured to one another adjacent a rear side of the helmet 10. The lateral straps 538 may also be attached to the visor 320. Any suitable attachment points for the mask 530 are contemplated without departing from the scope of the present disclosure as along as a suitable biasing force is exerted between the face of the wearer and the top edge 532*c* of the body 532 of the face mask 530 and maintained during use. The lateral straps 538 have herein a width of about 0.5 inch and a length of about 165 mm.

Figure 25:
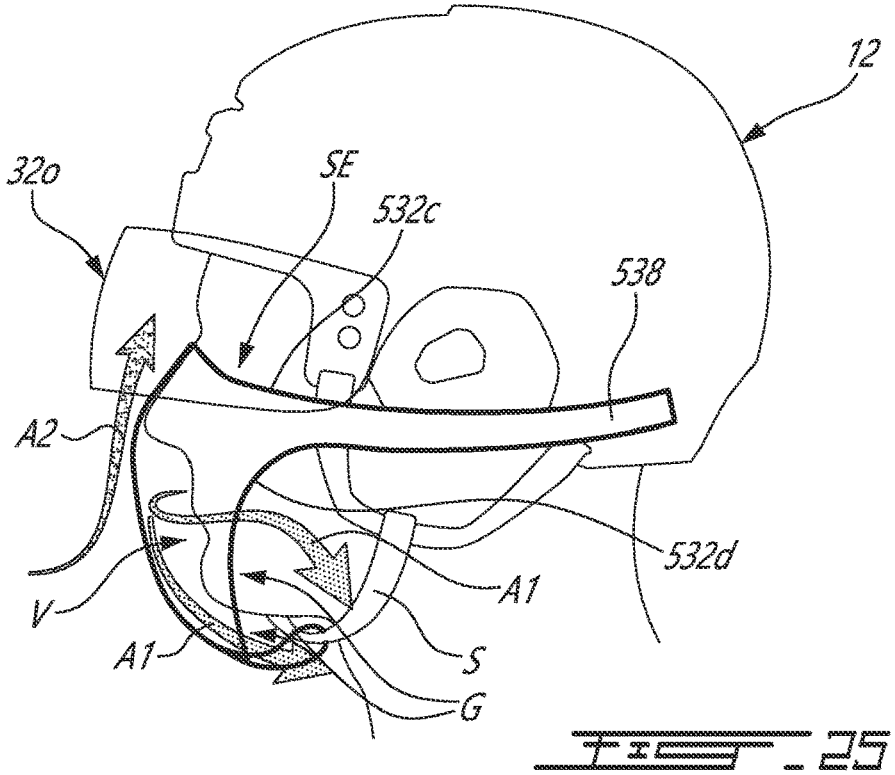
FIG. 25 is a schematic side, partially sectioned, view of the helmet of FIG. 24 equipped with the face mask of FIG. 22.

The mask 530 further includes a bottom strap 542 secured to the bottom edge 532*d* of the body 532 of the mask 530 at the lower most and centered point 532*f* of the bottom edge 532*d*. The bottom strap 542 has two opposed ends both secured to the bottom edge 532*d* to define a loop. As shown in FIGS. 24-25, the loop defined by the bottom strap 542 receives therein the chin strap S that is used to secure the helmet 10 to the head of the wearer by wrapping around the chin of the wearer. The bottom strap 542 is used to limit rotation and/or upward displacements of the mask 530 during use. The bottom strap 542 remains loose and is not used for biasing the mask 530 against the wearer. The bottom edge 532*d* is therefore floating or cantilevered thanks to the loose connection offered by the bottom strap 542. The bottom strap 542 has herein a thickness of about 0.5 inch and a total length of about 152 mm such that an effective length L of the bottom strap 542 is about 76 mm.

The body 532 of the face mask 530 is made of a material being suitably rigid to maintain the volume between the face mask 530 and the face of the wearer when the wearer is breathing and playing a sport. In other words, the face mask 530 has a stiffness selected such that a shape of the body is maintained when the wearer is breathing. An overlap between the top edge 532*a* of the mask 530 and the visor 320 is herein provided to avoid air from flowing between the visor 320 and the facemask 530. It will be appreciated that a bottom portion 532*h* of the body 532 of the mask 530, which is shown in tiered line in FIG. 22, may be made (or include) of a different material than a remainder of the body of the mask 530. The material of the bottom portion 532*h* may be stiffer and more rigid than other parts of the body 532 of the mask 530 to allow the mask 530 to maintain the volume V and gaps G between the face of the user and the mask 530 while in use. The bottom portion 532*h* may extend from below the nose N of the wearer. The bottom portion 532*h* faces the mouth and chin of the wearer.

Referring more particularly to FIG. 25, a volume V is defined between the face mask 530 and the face of the wearer and a gap G, which communicates with the volume V, is created between a bottom portion of the face of the wearer (e.g., mouth) and the bottom edge 532*d* of the body 532 of the face mask 530. As discussed herein above, the air exhaled by the wearer is received within the volume V and redirected away towards the gap G. The air exhaled by the wearer is able to flow out of the volume V between the face mask 530 and the face of the wearer via the gap G following arrows A1.

As described above, the two lateral straps 538 are used to pull the top edge 532*c* of the body 532 of the mask 530 in abutment against the face of the wearer. The top edge 532*c* therefore closely follows a shape of the face of the wearer to create a contact area SE between the top edge 532*c* of the mask 530 and the face of the wearer. The contact area SE limits air from flowing between the top edge 532*c* and the face of the wearer. In the embodiment shown, the top edge 532*c* of the body 532 of the mask 530 is biased against the face of the wearer thanks to the elastic strap portions 538*a* of the lateral straps 538 that pull the top edge 532*c* rearwardly against the face of the wearer.

When the wearer is wearing the helmet 10 with the half-visor 320 and the mask 530, the air penetrates between the half-visor 320 and the mask 530 along arrow A2. The air is then deviated away from the nose and mouth of the wearer thanks to mask 530 and contact area SE between the top edge 532*c* and the face of the wearer. The mask 530 may therefore protect the wearer against pathogens that may flow towards him/her during use. When the wearer exhales, the air is prevented from flowing substantially perpendicularly outwardly from the face of the wearer by the mask 530 and by the contact area SE between the top edge 532*c* and the face of the wearer. The mask 530 thereby acts as breath redirection mask and deviates the flow of exhaled air (arrow A1) received within the volume V towards the gap G between the bottom edge 532*d* of the mask 530 and the bottom portion of the face of the wearer. The exhaled air is therefore redirected in another direction besides a perpendicularly outward one and, thus, away from the most direct contamination path with other players.

To install the mask 530 to the helmet 10, the user adjust an effective length of the lateral straps 538 such that the elastic strap portions 538*a* are at least partially stretched upon the top edge 532*c* of the body 532 of the mask 530 in abutment against the face of the wearer and upon the first fasteners 540*a* of the snap buckles 538*c* engaged to the second fasteners 540*b* on the helmet 10. This may allow the elastic strap portions 538*a* to bias the top edge 532*c* of the mask 530 against the face of the wearer to substantially limit air from flowing between the top edge 532*c* and the wearer's face.

Herein, the expression "about" implies that a value may range from plus or minus 10% of the value. For instance, about 10 implies that the value may range from 9 to 11.

As can be seen therefore, the examples described above and illustrated are intended to be exemplary only. The scope is indicated by the appended claims.

What is claimed is:

1. A sports helmet comprising: a shell configured for enclosing at least a portion of a head of a wearer; a face protector secured to the shell for covering at least a portion of a face of the wearer; and a face mask disposed on an inner side of the face protector, the face mask having a body sized for overlapping a nose and a mouth of the wearer, the body shaped to define a volume between the face of the wearer and the body, the body defining a top edge for engaging the face of the wearer and disposed above the nose of the wearer and a bottom edge opposed to the top edge and disposed proximate a chin of the wearer, the bottom edge secured to a lower portion of the face protector at a location spaced apart from the face of the wearer to define a gap between the bottom edge and the face of the wearer, and lateral straps extending from respective lateral side ends of the body and configured for biasing the top edge against the face of the wearer, wherein the body is made of a material offering a flow resistance such that an exhalation flow from the wearer is deviated towards the gap and away from the face protector.

2. The sports helmet of claim 1, wherein the face protector defines openings, the face mask covering some of the openings that are facing the mouth of the wearer.

3. The sports helmet of claim 1, wherein the gap is defined between the chin and/or cheeks of the wearer.

4. The sports helmet of claim 1, wherein the face protector includes a chin cup, a portion of the face mask received between the face protector and the chin cup to define the gap and the volume.

5. The sports helmet of claim 4, comprising a bottom strap having a first end and a second end opposed to the first end, the first end secured to an outer side of the body of the face mask, the second end removably securable to an inner side of the body of the face mask.

6. The sports helmet of claim 1, wherein the top edge of the body of the facemask defines a contact area shaped to follow the face of the wearer, the top edge sealingly engaging the face of the wearer at the contact area.

7. The sports helmet of claim 1, wherein the face protector defines longitudinal members and transverse members, the lateral straps wrapping around the longitudinal members, each of the lateral straps defining a first fastener and a second fastener at respective opposed ends of the lateral straps, the first fastener removably securable to the second fastener.

8. The sports helmet of claim 7, comprising a bottom strap secured to the bottom edge and wrapping around one of the transverse members, a distal end of the bottom strap defining a third fastener removably securable to a fourth fastener located on an inner side of the body of the face mask.

9. The sports helmet of claim 1, wherein the face protector defines longitudinal members and transverse members, the lateral straps wrapping around a bottom one of the transverse members.

10. The sports helmet of claim 1, wherein the body of the face mask defines a cup-shape for receiving a portion of the face of the wearer and for defining the volume.

11. The sports helmet of claim 1, wherein the face mask is removably securable to the face protector.

12. A sports helmet comprising: a shell enclosing at least a portion of a head of a wearer; a face protector secured to the shell and configured for covering at least a portion of a face of the wearer; and a face mask removably securable to the face protector and having a body sized for covering a nose and a mouth of the wearer, the body shaped to define a volume between the face of the wearer and the body, the body defining a top edge for engaging the face of the wearer above the nose of the wearer and a bottom edge opposed to the top edge and disposed proximate a chin of the wearer, the body made of a material having a stiffness selected such that a shape of the body is maintained when the wearer is breathing, lateral straps extending from respective lateral side ends of the body and secured to one or both of the face protector and the shell for biasing the top edge against the face of the wearer, and a gap between the bottom edge and the face of the wearer, the gap communicating with the volume and oriented away from the face protector such that an exhalation flow from the wearer exits the volume in a direction facing away from the face protector.

13. The sports helmet of claim 12, comprising a bottom strap defining a loop and a chin strap secured to the shell, the chin strap receivable within the loop of the bottom strap.

14. The sports helmet of claim 12, wherein the gap is defined between the chin and/or cheeks of the wearer.

15. The sports helmet of claim 12, wherein the top edge of the body of the facemask defines a contact area shaped to follow a shape of the face of the wearer, the top edge sealingly engaging the face of the wearer at the contact area.

16. The sports helmet of claim 12, wherein the body of the face mask defines two internal edges secured to one another, the body of the face mask defining a cup-shaped for receiving a portion of the face of the wearer and for defining the volume.

17. A face protection assembly for a sports helmet, comprising: a face protector securable to a shell of the sports helmet, the face protector sized for covering at least a portion of a face of a wearer; and a face mask removably secured to the face protector on an inner side of the face protector, the face mask having a body shaped to define a volume between the face of the wearer and the body, the body defining a top edge shaped to engage the face of the wearer and disposed above a nose of the wearer and a bottom edge opposed to the top edge and disposed proximate a chin of the wearer, the bottom edge secured to a lower portion of the face protector at a location spaced apart from the face of the wearer to define a gap between the bottom edge and the face of the wearer and lateral straps extending from respective lateral side ends of the body and secured to the face protector and/or the shell for biasing the top edge against the face of the wearer, wherein the body is made of a material offering a flow resistance such that an exhalation flow from the wearer is deviated towards the gap and away from the face protector.

* * * * *